US006823289B2

(12) United States Patent
Kasuya et al.

(10) Patent No.: US 6,823,289 B2
(45) Date of Patent: Nov. 23, 2004

(54) PUMP TROUBLE DIAGNOSING DEVICE FOR HYDRAULIC DRIVE DEVICE AND DISPLAY DEVICE OF THE DIAGNOSING DEVICE

(75) Inventors: Hirotsugu Kasuya, Tsuchiura (JP); Yutaka Watanabe, Tsuchiura (JP); Masami Ochiai, Atsgui (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 110 days.

(21) Appl. No.: 10/257,013

(22) PCT Filed: Feb. 14, 2002

(86) PCT No.: PCT/JP02/01211

§ 371 (c)(1),
(2), (4) Date: Oct. 7, 2002

(87) PCT Pub. No.: WO02/064980

PCT Pub. Date: Aug. 22, 2002

(65) Prior Publication Data

US 2003/0144818 A1 Jul. 31, 2003

(30) Foreign Application Priority Data

Feb. 15, 2001 (JP) ..... 2001-39112

(51) Int. Cl.[7] ..... G06F 15/00; G01M 3/00

(52) U.S. Cl. ..... 702/185; 73/46; 73/118.1; 714/26

(58) Field of Search ..... 702/182, 183, 702/185; 714/38, 26; 73/40, 46, 49.7, 73.118, 1; 417/213

(56) References Cited

U.S. PATENT DOCUMENTS 5,074,145 A * 12/1991 Hattori et al. ..... 73/118.1
5,919,267 A * 7/1999 Urnes et al. ..... 714/26
6,055,851 A 5/2000 Tanaka et al. ..... 73/46

FOREIGN PATENT DOCUMENTS

JP 407294365 A * 11/1995
JP 10-54371 2/1998
JP 2000-283022 10/2000
WO WO98/06946 2/1998

* cited by examiner

*Primary Examiner*—John Barlow
*Assistant Examiner*—John Le
(74) *Attorney, Agent, or Firm*—Mattingly, Stanger & Malur, P.C.

(57) ABSTRACT

Fault diagnosis of hydraulic pumps is made automatically during an actual operation of a working machine, particularly when there is a problem with horsepower limiting control of the hydraulic pumps. A controller 50 performs horsepower limiting control for a plurality of variable displacement hydraulic pumps 1 to 6. The controller 50 measures a pump delivery pressure and pump delivery rate of each hydraulic pump when the pump delivery rate reaches a maximum during operation of the hydraulic drive system based on their detected values, collects the measured values as fault diagnostic data, and then compares a calculated target pump delivery rate with the collected pump delivery rate to decide if there is a fault of the hydraulic pump.

13 Claims, 27 Drawing Sheets

AT TIME OF MAXIMUM FLOW RATE

| PRESSURE | FLOW RATE | DECISION |
|---|---|---|
| $D1_1(n-9)$ | $D1_2(n-9)$ | $D1_7(n-9)$ |
| $D1_1(n-8)$ | $D1_2(n-8)$ | $D1_7(n-8)$ |
| $D1_1(n-7)$ | $D1_2(n-7)$ | $D1_7(n-7)$ |
| $D1_1(n-6)$ | $D1_2(n-6)$ | $D1_7(n-6)$ |
| $D1_1(n-5)$ | $D1_2(n-5)$ | $D1_7(n-5)$ |
| ⋮ | ⋮ | ⋮ |
| $D1_1(n)$ | $D1_2(n)$ | $D1_7(n)$ |

FIG. 17

AT TIME OF
MAXIMUM PRESSURE

| PRESSURE | FLOW RATE | DECISION |
|---|---|---|
| $D1_5(n-9)$ | $D1_6(n-9)$ | $D1_7(n-9)$ |
| $D1_5(n-8)$ | $D1_6(n-8)$ | $D1_7(n-8)$ |
| $D1_5(n-7)$ | $D1_6(n-7)$ | $D1_7(n-7)$ |
| $D1_5(n-6)$ | $D1_6(n-6)$ | $D1_7(n-6)$ |
| $D1_5(n-5)$ | $D1_6(n-5)$ | $D1_7(n-5)$ |
| ⋮ | ⋮ | ⋮ |
| $D1_5(n)$ | $D1_6(n)$ | $D1_7(n)$ |

FIG.21

| AT TIME OF MAXIMUM FLOW RATE | | AT TIME OF MAXIMUM PRESSURE | | DECISION |
|---|---|---|---|---|
| PRESSURE | FLOW RATE | PRESSURE | FLOW RATE | |
| $D1_1(n-9)$ | $D1_2(n-9)$ | $D1_5(n-9)$ | $D1_6(n-9)$ | $D1_7(n-9)$ |
| $D1_1(n-8)$ | $D1_2(n-8)$ | $D1_5(n-8)$ | $D1_6(n-8)$ | $D1_7(n-8)$ |
| $D1_1(n-7)$ | $D1_2(n-7)$ | $D1_5(n-7)$ | $D1_6(n-7)$ | $D1_7(n-7)$ |
| $D1_1(n-6)$ | $D1_2(n-6)$ | $D1_5(n-6)$ | $D1_6(n-6)$ | $D1_7(n-6)$ |
| $D1_1(n-5)$ | $D1_2(n-5)$ | $D1_5(n-5)$ | $D1_6(n-5)$ | $D1_7(n-5)$ |
| ⋮ | ⋮ | ⋮ | ⋮ | ⋮ |
| $D1_1(n)$ | $D1_2(n)$ | $D1_5(n)$ | $D1_6(n)$ | $D1_7(n)$ |

FIG.24

| AT TIME OF MAXIMUM FLOW RATE | | AT TIME OF INTERMEDIATE PRESSURE | | AT TIME OF MAXIMUM PRESSURE | | DECISION |
|---|---|---|---|---|---|---|
| PRESSURE | FLOW RATE | PRESSURE | FLOW RATE | PRESSURE | FLOW RATE | |
| $D1_1(n-9)$ | $D1_2(n-9)$ | $D1_3(n-9)$ | $D1_4(n-9)$ | $D1_5(n-9)$ | $D1_6(n-9)$ | $D1_7(n-9)$ |
| $D1_1(n-8)$ | $D1_2(n-8)$ | $D1_3(n-8)$ | $D1_4(n-8)$ | $D1_5(n-8)$ | $D1_6(n-8)$ | $D1_7(n-8)$ |
| $D1_1(n-7)$ | $D1_2(n-7)$ | $D1_3(n-7)$ | $D1_4(n-7)$ | $D1_5(n-7)$ | $D1_6(n-7)$ | $D1_7(n-7)$ |
| $D1_1(n-6)$ | $D1_2(n-6)$ | $D1_3(n-6)$ | $D1_4(n-6)$ | $D1_5(n-6)$ | $D1_6(n-6)$ | $D1_7(n-6)$ |
| $D1_1(n-5)$ | $D1_2(n-5)$ | $D1_3(n-5)$ | $D1_4(n-5)$ | $D1_5(n-5)$ | $D1_6(n-5)$ | $D1_7(n-5)$ |
| ⋮ | ⋮ | ⋮ | ⋮ | ⋮ | ⋮ | ⋮ |
| $D1_1(n)$ | $D1_2(n)$ | $D1_3(n)$ | $D1_4(n)$ | $D1_5(n)$ | $D1_6(n)$ | $D1_7(n)$ |

PUMP TROUBLE DIAGNOSING DEVICE FOR HYDRAULIC DRIVE DEVICE AND DISPLAY DEVICE OF THE DIAGNOSING DEVICE

This application claims priority from PCT/JP02/01211 filed Feb. 14, 2002.

TECHNICAL FIELD

The present invention relates to a pump fault diagnostic apparatus for a hydraulic drive system, and more particularly, to a pump fault diagnostic apparatus provided in a hydraulic drive system of a working machine which performs operations by driving a plurality of hydraulic actuators by a plurality of variable displacement hydraulic pumps, for performing a fault diagnosis of each hydraulic pump, and a display unit thereof.

BACKGROUND ART

There are working machines such as a hydraulic excavator that performs required operations by driving a plurality of hydraulic actuators by hydraulic fluids delivered from a plurality of hydraulic pumps. Of such working machines, for example, a large hydraulic excavator requires a large flow rate of hydraulic fluid to drive one hydraulic actuator, and therefore hydraulic fluids delivered from a plurality of hydraulic pumps are combined or joined to drive one hydraulic actuator. For this reason, when an abnormality is found in driving of a given hydraulic actuator, it is necessary to detect which hydraulic pump has trouble.

A conventional pump fault diagnostic apparatus for determining a faulty hydraulic pump is disclosed in JP, A, 10-54371. This pump fault diagnostic apparatus takes note of check valves placed to prevent backflows when hydraulic fluids delivered from a plurality of hydraulic are joined, and provides a differential pressure sensor to measure a differential pressure across these check valves and places a switch to operate the hydraulic pump to take a maximum tilting position. An operator of the working machine or a service man for maintenance of the working machine presses the switch to operate the hydraulic pump to take the maximum tilting position when the working machine is not operated and decides the quality of the hydraulic pump using a measured value of the differential pressure sensor when the hydraulic pump delivery rate is set at the maximum.

DISCLOSURE OF THE INVENTION

However, the above conventional art has the following problems.

The pump fault diagnostic apparatus described in JP, A, 10-54371 is such that the operator or the service man presses the switch to operate the hydraulic pump to take the maximum tilting position and then performs a fault diagnosis of the hydraulic pump as described above. Thus, the fault diagnosis of the hydraulic pump can be performed not when the working machine is actually operated but when the working machine is not operated. Furthermore, the operator or the service man has to press the switch, which is troublesome.

Furthermore, the hydraulic drive system of the working machine is generally designed to perform horsepower limiting control of the hydraulic pump so that the maximum pump delivery rate decreases as the pump delivery pressure increases. In the above pump fault diagnostic apparatus, the hydraulic pump is operated to take the maximum tilting position and the quality of the hydraulic pump is decided according to the delivery rate situation of the hydraulic pump at that time, and therefore, as a fault example of the hydraulic pump, a fault in which the hydraulic pump does not reach the maximum tilting position and the delivery rate of the pump becomes in short can be detected, but a fault when the hydraulic pump has a problem with the horsepower limiting control such that the delivery rate of the hydraulic pump does not reach a value specified by the horsepower limiting control when the delivery pressure of the hydraulic pump increases cannot be detected.

It is a first object of the present invention to provide a pump fault diagnostic apparatus for a hydraulic drive system and a display unit thereof which is capable of automatically making a fault diagnosis of the hydraulic pump during an actual operation of a working machine.

It is a second object of the present invention to provide a pump fault diagnostic apparatus for a hydraulic drive system and a display unit thereof which is capable of detecting a fault when there is a problem with horsepower limiting control of the hydraulic pump.

(1) To attain the above first and second objects, the present invention provides a pump fault diagnostic apparatus for a hydraulic drive system having at least one variable displacement hydraulic pump and horsepower limiting control means for controlling the hydraulic pumps such that a maximum pump delivery rate is reduced as a delivery pressure of the hydraulic pump increases, wherein the apparatus comprises: first sensor means for detecting the delivery rate of the hydraulic pump; second sensor means for detecting the delivery pressure of the hydraulic pump; data collecting means for measuring the pump delivery rate and pump delivery pressure during operation of the hydraulic drive system based on the detected values of the plurality of first sensor means and second sensor means and collecting the measured values as fault diagnostic data; and fault deciding means for calculating a target pump delivery rate of horsepower limiting control corresponding to the pump delivery pressure collected by the data collecting means, comparing the pump delivery rate collected by the data collecting means and the calculated target pump delivery rate and making a fault decision of the hydraulic pump.

By arranging the first and second sensor means, data collecting means and fault deciding means in this way, and collecting data of a pump delivery rate and a pump delivery pressure during the operation of the hydraulic drive system and comparing the target pump delivery rate of horsepower limiting control corresponding to this collected pump delivery rate and the collected pump delivery rate to make a fault decision of the hydraulic pump, it is possible to make a fault diagnosis of the hydraulic pump automatically during an actual operation of a working machine and detect a fault when there is any problem with horsepower limiting control of the hydraulic pump.

(2) To attain the above first and second objects, the present invention further provides a pump fault diagnostic apparatus for a hydraulic drive system having a plurality of variable displacement hydraulic pumps and horsepower limiting control means for controlling the plurality of hydraulic pumps such that respective maximum pump delivery rates are reduced as respective delivery pressures of the hydraulic pumps increase, wherein the apparatus comprises: first sensor means for detecting the respective delivery rates of the plurality of hydraulic pumps; second sensor means for detecting the respective delivery pressures of the plurality of hydraulic pumps; data collecting means for measuring, for each of the hydraulic pump, the pump delivery rate and pump delivery pressure while during operation of the hydraulic drive apparatus based on the detected values of the plurality of first sensor means and second sensor means and collecting the measured values as fault diagnostic data; and fault deciding means for calculating, for each of the hydraulic pump, a target pump delivery rate of horsepower limiting control corresponding to the pump delivery pressure collected by the data collecting means, comparing the pump delivery rate collected by the data collecting means and the calculated target pump delivery rate and making a fault decision of each of the hydraulic pumps.

With such features, as described in (1) above, it is possible to make a fault diagnosis of the hydraulic pump automatically during an actual operation of a working machine and detect a fault when there is any problem with horsepower limiting control of the hydraulic pumps, and further since data collection and fault decision are performed for each hydraulic pump, it is possible to detect a fault of the hydraulic pump while determining which of the plurality of hydraulic pumps has a problem.

(3) In the above (2), preferably, the data collecting means measures, for each of the hydraulic pump, the pump delivery pressure and pump delivery rate when the pump delivery rate reaches a maximum during operation of the hydraulic drive system based on the detected values of the plurality of first sensor means and second sensor means and collects the measured values as fault diagnostic data.

With such features, it is possible to detect faults of the hydraulic pump such as a fault where there is a problem with the tilting mechanism of the hydraulic pump and the hydraulic pump fails to reach the maximum tilting position or a fault where there is a problem with horsepower limiting control of the hydraulic pump and the delivery rate of the hydraulic pump as a whole does not reach a specified value of horsepower limiting control.

(4) Furthermore, in the above (2), preferably, the data collecting means measures, for each of the hydraulic pump, the pump delivery rate and pump delivery pressure when the pump delivery pressure reaches a maximum during operation of the hydraulic drive system based on the detected values of the plurality of first sensor means and second sensor means and collects the measured values as fault diagnostic data.

With such features, it is possible to detect faults of the hydraulic pump such as a fault where there is a problem with horsepower limiting control of the hydraulic pump and the delivery rate of the hydraulic pump as a whole does not reach a specified value of horsepower limiting control or a fault where the delivery rate of the hydraulic pump fails to reach a specified value of horsepower limiting control when the delivery pressure of the hydraulic pump increases.

(5) Furthermore, in the above (2), preferably, the data collecting means measures, for each of the hydraulic pumps, the pump delivery pressure and pump delivery rate when the pump delivery rate reaches a maximum and the pump delivery rate and pump delivery pressure when the pump delivery pressure reaches a maximum during operation of the hydraulic drive system based on the detected values of the plurality of first sensor means and second sensor means and collects the measured values as fault diagnostic data.

With such features, it is possible to detect faults of the hydraulic pump such as a fault where there is a problem with the tilting mechanism of the hydraulic pump and the hydraulic pump fails to reach the maximum tilting position, or a fault where there is a problem with horsepower limiting control of the hydraulic pump and the delivery rate of the hydraulic pump as a whole does not reach a specified value of horsepower limiting control, or a fault where the delivery rate of the hydraulic pump fails to reach a specified value of horsepower limiting control when the delivery pressure of the hydraulic pump increases.

(6) Furthermore, in the above (2), preferably, the data collecting means measures, for each of the hydraulic pump, the pump delivery pressure and pump delivery rate when the pump delivery rate reaches a maximum, the pump delivery rate and pump delivery pressure when the pump delivery pressure reaches a maximum and the pump delivery rate and pump delivery pressure when the pump delivery pressure reaches a predetermined intermediate pressure during operation of the hydraulic drive system based on the detected values of the plurality of first sensor means and second sensor means and collects the measured values as fault diagnostic data.

With such features, it is possible to detect faults of the hydraulic pump such as a fault where there is a problem with the tilting mechanism of the hydraulic pump and the hydraulic pump fails to reach the maximum tilting position, or a fault where there is a problem with horsepower limiting control of the hydraulic pump and the delivery rate of the hydraulic pump as a whole does not reach a specified value of horsepower limiting control, or a fault where the delivery rate of the hydraulic pump fails to reach a specified value of horsepower limiting control when the delivery pressure of the hydraulic pump increases. Further, it is possible to accurate by detect a fault where there is a problem with horsepower limiting control of the hydraulic pumps.

(7) In the above (2) to (6), preferably, each of the plurality of first sensor means includes a displacement sensor for measuring a poppet displacement of a check valve provided in the delivery line of each hydraulic pump and calculates the delivery rate of each hydraulic pump from the output result of the displacement sensor.

With such features, it is possible to construct the first sensor means by utilizing check valves provided in the hydraulic system in which fluid flows from a plurality of hydraulic pumps are joined and thus to provide an inexpensive pump fault diagnostic apparatus.

(8) In the above (2) to (6), each of the plurality of first sensor means may include a differential pressure sensor for measuring a differential pressure across a check valve provided in the delivery line of each hydraulic pump and calculates the delivery rate of each hydraulic pump from the output result of the differential pressure sensor.

With such features, it is also possible to construct the first sensor means by utilizing check valves provided in the hydraulic system in which fluid flows from a plurality of hydraulic pumps are joined and thus to provide an inexpensive pump fault diagnostic apparatus.

(9) Furthermore, in the above (2) to (6), preferably, the system further comprises: fault displaying means having a plurality of alarm lamps provided correspondingly to the plurality of hydraulic pumps for turning on the corresponding alarm lamp when the fault deciding means decides that any of the plurality of hydraulic pumps is faulty.

With such features, it is possible to inform an operator of a machine of faults of the hydraulic pumps by the alarm lamps.

(10) In the above (9), preferably, the fault displaying means changes lamp colors between a case where there is a possibility of fault in the hydraulic pump and a case where the possibility is a higher.

With such features, it is possible to inform an operator of a machine of details of a fault condition of the hydraulic pumps.

(11) Furthermore, in the above (2) to (6), preferably, the data collecting means collects the fault diagnostic data for every operation of the hydraulic drive system and the fault deciding means decides whether the hydraulic pumps are faulty or not based on the decision result of the fault diagnostic data for a predetermined number of times of the operations.

With such features, it is possible to accurate by detect faults of the hydraulic pumps.

(12) Furthermore, in the above (2) to (6), preferably the fault deciding means includes a plurality of pump delivery pressure/pump delivery rate conversion maps, and selects one of them and calculates the target pump delivery rate using the selected conversion map.

With such features, even if the horsepower limiting control means is provided with a plurality of conversion maps for horsepower limiting control preset according to the operating mode or engine speed and the conversion map for horsepower limiting control is changed during an actual operation of a working machine, it is possible to select a pump delivery pressure/pump delivery rate conversion map that corresponds to the conversion map used for horsepower limiting control, and thus it is possible to make a fault diagnosis of the hydraulic pump as described in the above (1) and (2).

(13) Furthermore, in order to attain the first and second objects above, the present invention provides a display unit of a pump fault diagnostic apparatus for a hydraulic drive system having a plurality of variable displacement hydraulic pumps and horsepower limiting control means for controlling a plurality of hydraulic pumps such that a maximum pump delivery rate is reduced as delivery pressures of these hydraulic pumps increase, wherein: the display unit comprises a plurality of alarm lamps provided correspondingly to the plurality of hydraulic pumps, and turns on the corresponding alarm lamp when the pump fault diagnostic apparatus decides that there is a problem with the horsepower control means of any of the plurality of hydraulic pumps.

With such features, it is possible to warn an operator of a machine about a fault condition of the hydraulic pumps the alarm lamps.

BRIEF DESCRIPTION OF THE DRAWINGS

FIG. 17 illustrates a data storage situation used in the decision processing program shown in FIG. 16;

FIG. 21 illustrates a data storage situation used in the decision processing program shown in FIG. 20;

FIG. 24 illustrates a data storage situation used in the decision processing program shown in FIG. 23;

BEST MODE FOR CARRYING OUT THE INVENTION

With reference now to the attached drawings, embodiments of the present invention will be explained below.

First, a first embodiment of the present invention will be explained with reference to FIG. 1 to FIG. 14.

Figure 1:
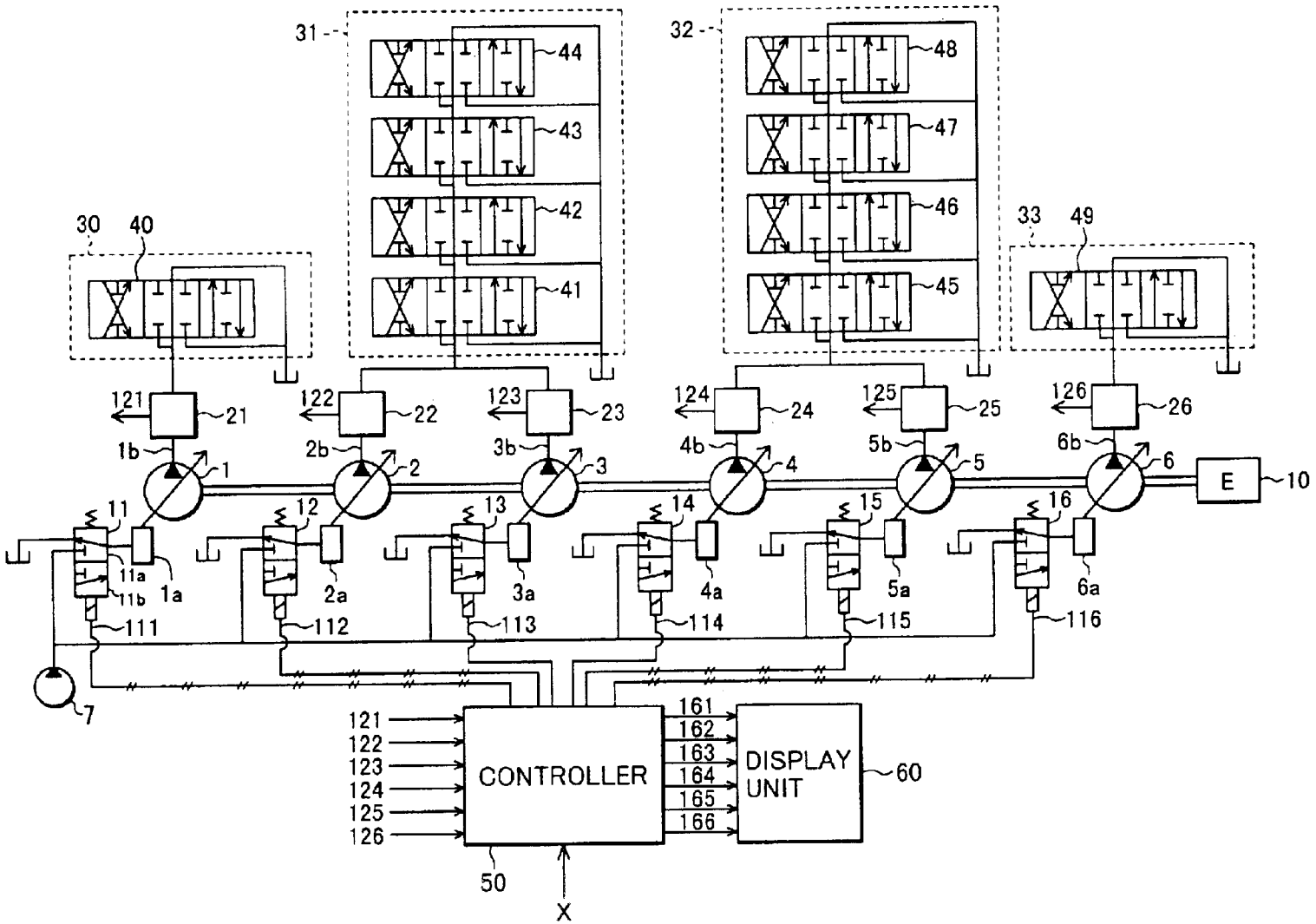
FIG. 1 illustrates a pump fault diagnostic apparatus according to a first embodiment of the present invention together with a hydraulic drive system equipped with the pump fault diagnostic apparatus.

FIG. 1 illustrates a pump fault diagnostic apparatus for a hydraulic drive system provided on a large hydraulic excavator according to the first embodiment of the present invention together with the hydraulic drive system.

In FIG. 1, the hydraulic drive system according to this embodiment is provided with variable displacement hydraulic pumps 1 to 6 driven by an engine 10 and these hydraulic pumps 1 to 6 are provided with regulators 1*a* to 6*a* and the regulators 1*a* to 6*a* are driven by control pressures output from solenoid valves 11 to 16 to control delivery rates of the hydraulic pumps 1 to 6. The solenoid valves 11 to 16 are activated by currents of signal lines 111 to 116 output from a controller 50 to change the switching positions and generate the control pressures based on a delivery pressure of a pilot pump 7. That is, the delivery rates of the hydraulic pumps 1 to 6 are controlled according to the switching positions of the solenoid valves 11 to 16.

Taking the solenoid valve 11 as an example, when the current of the signal line 111 output from the controller 50 is low and the solenoid valve 11 is at a position 11*a*, a hydraulic fluid from the pilot pump 7 is not supplied to the regulator 1*a* and the regulator 1*a* operates to decrease the delivery rate of the hydraulic pump 1. When the current of the signal line 111 output from the controller 50 increases and the solenoid valve 11 is switched to a position 11*b*, the hydraulic fluid from the pilot pump 7 is supplied to the regulator 1*a* and the regulator 1*a* operates to increase the delivery rate of the hydraulic pump 1. The same applies to the other solenoid valves 12 to 16 and regulators 2*a* to 6*a*.

The controller 50 performs predetermined calculation processing based on demanded flow rate signals X and delivery pressures of the hydraulic pumps 1 to 6 to generate the currents of the signal lines 111 to 116 (described later).

Then, portions to which the hydraulic fluids delivered from the hydraulic pumps 1 to 6 are supplied will be explained.

A hydraulic fluid delivered from the hydraulic pump 1 is supplied to a valve block 30, hydraulic fluids delivered from the hydraulic pumps 2 and 3 are supplied to a valve block 31, hydraulic fluids delivered from the hydraulic pumps 4 and 5 are supplied to a valve block 32 and a hydraulic fluid delivered from the hydraulic pump 6 is supplied to a valve block 33.

A directional control valve 40 is placed in the valve block 30, directional control valves 41 to 44 are placed in the valve block 31, directional control valves 45 to 48 are placed in the valve block 32 and a directional control valve 49 is placed in the valve block 33. The directional control valves 40 to 49 are connected to their respective hydraulic actuators (not shown) and control the flow rates and directions of the hydraulic fluids supplied to these hydraulic actuators and drive the hydraulic actuators.

The pump fault diagnostic apparatus of this embodiment is installed on such a hydraulic drive system and comprise measuring units 21 to 26 set in delivery lines 1*b* to 6*b* of the hydraulic pumps 1 to 6, the above-described controller 50 and a display unit 60. Measured values of the measuring units 21 to 26 are sent to the controller 50 via their respective signal lines 121 to 126 and the controller 50 makes a fault diagnosis of the hydraulic pumps 1 to 6 using the measured values and sends the diagnosis results to the display unit 60 via signal lines 161 to 166 and the display unit 60 displays the fault situations of the pumps to inform the operator or maintenance personnel of the machine of the fault situations.

Then, details of each of the units and fault diagnostic technology will be explained by using FIG. 2 to FIG. 14.

First, the structures of the measuring units 21 to 26 will be explained.

The measuring units 21 to 26 have the same structure, and therefore the detailed structures of the measuring units 21 to 26 will be explained taking the measuring unit 21 as an example by using FIG. 2.

Figure 2:
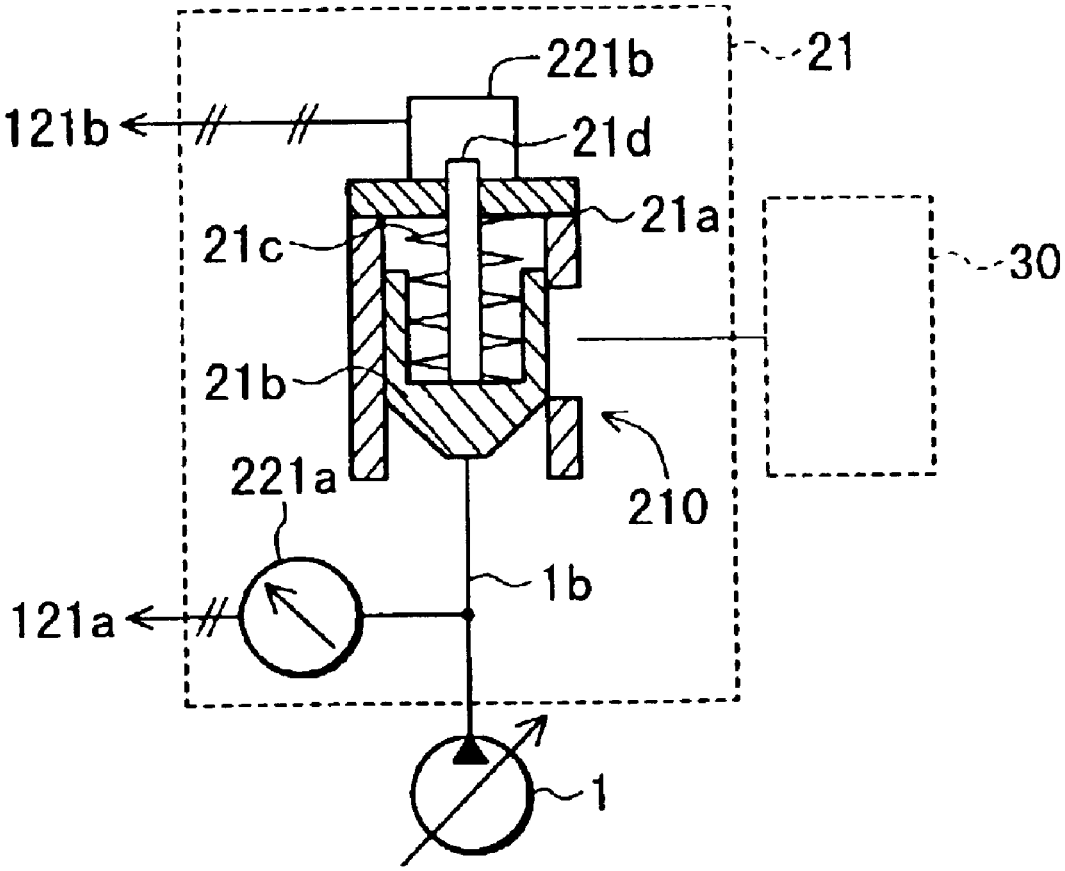
FIG. 2 is a detail view of a structure of the measuring unit shown in FIG. 1.

In FIG. 2, the measuring unit 21 is provided with a check valve 210 including a check valve body 21*a*, a poppet 21*b* placed in the check valve body 21*a* and a spring 21*c* supporting the poppet 21*b*, a detection rod 21*d* arranged to contact the poppet 21*b* of the check valve 210 and a displacement sensor 221*b* for measuring the displacement of the poppet 21*b* by measuring the displacement of the detection rod 21*d*. The measuring unit 21 is also provided with a pressure sensor 221*a* connected to the delivery line 1*b* of the hydraulic pump 1.

Here, the operation of the measuring unit 21 will be explained.

When a hydraulic fluid is supplied from the hydraulic pump 1 to the valve block 30, the pump delivery pressure is detected by the pressure sensor 221*a* and the detected signal is output by the signal line 121*a*. Furthermore, the displacement of the poppet 21*b* changes according to the flow rate of the hydraulic fluid supplied to the valve block 30 and the displacement of this poppet 21*b* is detected by the displacement sensor 221*b* and the detected signal is output by the signal line 121*b*. The signal line 121*a* and the signal line 121*b* constitute the above-described signal line 121.

The same applies to the measuring units 22 to 26.

Thus, the signals of delivery pressures of the hydraulic pumps 1 to 6 measured by the measuring units 21 to 26 and the signals of poppet displacements that change according to the delivery rates of the hydraulic pumps 1 to 6 are led to the controller 50 via the signal lines 121 to 126.

Furthermore, generally, check valves are placed in the delivery lines 2*b* to 5*b* of the hydraulic pumps 2 to 5 to prevent backflows of hydraulic fluids when the hydraulic fluids delivered by the hydraulic pumps 2 and 3 or hydraulic pumps 4 and 5 are joined. The measuring units 22 to 25 for the hydraulic pumps 2 to 5 can use those check valves as the above-described check valve 210. By constructing the measuring units using the existing check valves makes in such a manner, it is possible to manufacture the measuring units at lower costs.

Then, details of the controller 50 will be explained.

Figure 3:
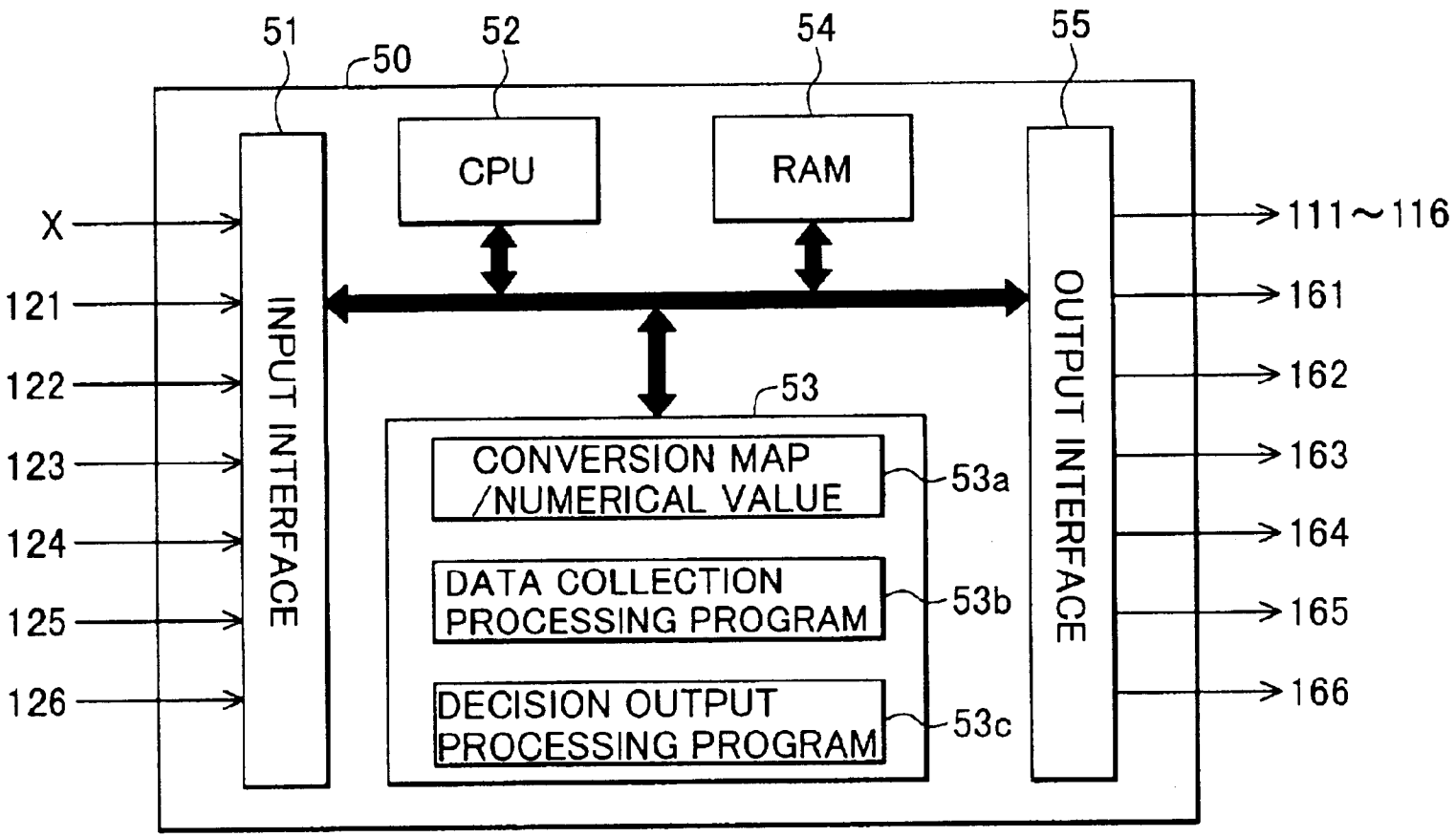
FIG. 3 illustrates an outline of an internal structure of the controller shown in FIG. 1.

FIG. 3 illustrates an outline of an internal structure of the controller 50.

In FIG. 3, the controller 50 includes an input interface 51 provided with an A/D converter to receive demanded flow rate signals X and signals from the measuring units 21 to 26, a central processing unit (CPU) 52 that performs predetermined calculations and control, a read-only memory (ROM) 53 that stores software such as a control program used in the CPU 52, a random access memory (RAM) 54 that temporarily stores calculation results, etc. and an output interface 55 that outputs drive currents and signals of fault situation of the respective hydraulic pumps to the solenoid valves 11 to 16 and display unit 60.

Then, the processing content of the controller 50 will be explained.

First, as described above, the controller 50 performs predetermined calculations based on the demanded flow rate signals X and delivery pressures of the hydraulic pumps 1 to 6 and generates currents to control the delivery rates of the hydraulic pumps 1 to 6. As a method of controlling the hydraulic pumps 1 to 6 based on the demanded flow rate signals X, an appropriate one such as positive control, negative control, load sensing control, etc. can be used depending on the hydraulic system mounted on the hydraulic excavator. The delivery pressures of the hydraulic pumps 1 to 6 is used for horsepower limiting control of the hydraulic pumps 1 to 6.

Figure 4:
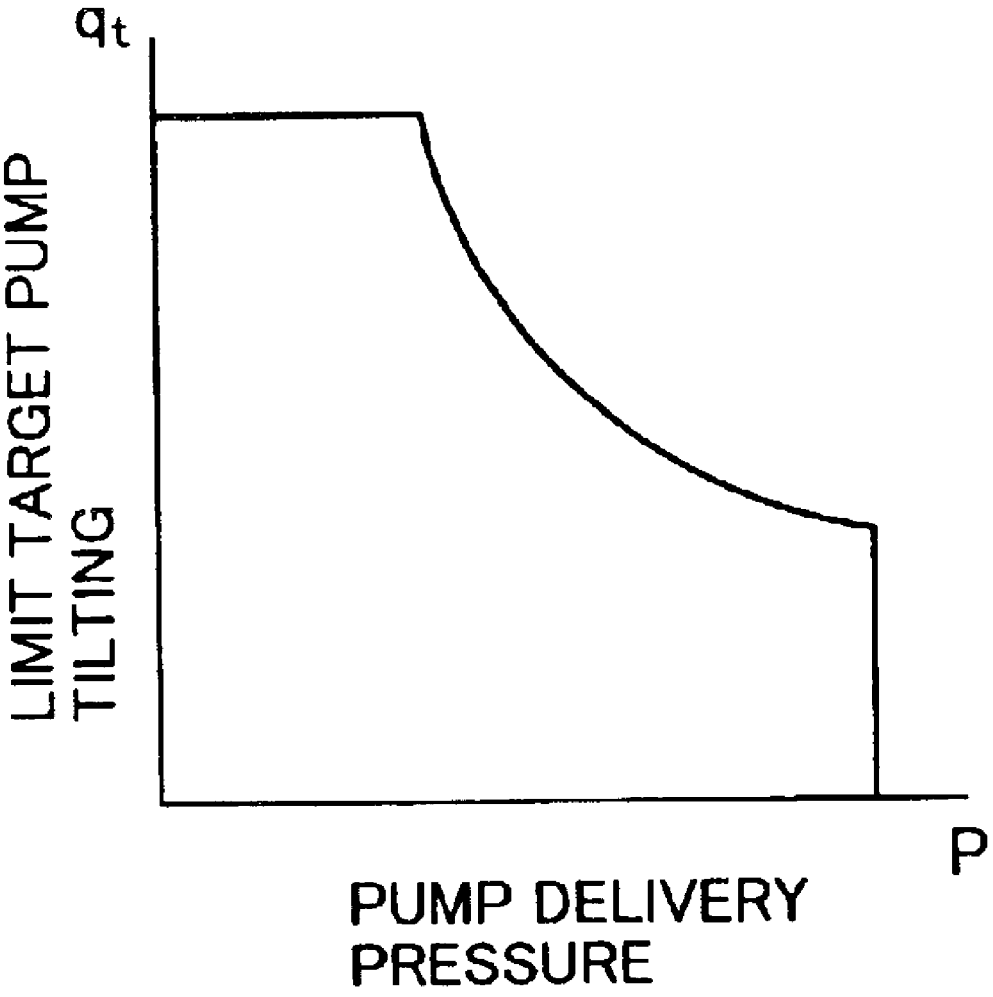
FIG. 4 illustrates a conversion map of input torque limiting control for performing horsepower limiting control of the hydraulic pumps stored in a ROM of the controller shown in FIG. 3.

FIG. 4 shows an input torque limiting control conversion map to carry out horsepower limiting control of the hydraulic pumps 1 to 6. This conversion map is stored in the ROM 53. The input torque limiting control means limiting the maximum values of the input torques of the hydraulic pumps 1 to 6 thereby controlling the input torque of the hydraulic pumps 1 to 6 not so as to exceed the output torque of the engine 10. The conversion map sets the relationship between the pump delivery pressure P and a limiting target pump tilting qt so that when the pump delivery pressure P increases, the product (input torque) of P and qt is kept constant.

The controller 50 calculates a corresponding limiting target pump tilting angle qt from the delivery pressure of the hydraulic pump 1, for example, and when the demanded target pump tilting qx calculated from the demanded flow rate signal X is equal to or smaller than the limiting target pump tilting angle qt ($qx \leqq qt$), the controller 50 sets qx as an output target pump tilting angle qz ($qz=qx$), and when the demanded target pump tilting qx is greater than the limiting target pump tilting angle qt ($qx > qt$), the controller 50 sets qt as the output target pump tilting angle qz ($qz=qt$), thereby controlling the tilting of the hydraulic pump 1 not so as to exceed the limiting target pump tilting angle qt for limiting the maximum value of the input torque. The same applies to the hydraulic pumps 2 to 6. By limiting the maximum value of the input torques of the hydraulic pumps 1 to 6 in such a manner, consumed horsepower of the hydraulic pumps 1 to 6 is resultantly controlled not so as to exceed the output horsepower of the engine 10 thereby allowing horsepower limiting control of the hydraulic pumps 1 to 6. The delivery pressures P of the hydraulic pumps 1 to 6 can be obtained by output voltages V1 of the pressure sensors 221*a* led from the measuring units 21 to 26 via the signal lines 121 to 126 (described later).

Next, the pump fault diagnostic processing of the controller 50 will be explained.

The ROM 53 of the controller 50 has an area 53*a* that stores conversion maps and required numerical values, etc., an area 53*b* that stores a data collection processing program and an area 53*c* that stores a decision output processing program.

The conversion maps and required numerical values stored in the area 53*a* of the ROM 53 will be explained by using FIG. 5 to FIG. 8.

Figure 5:
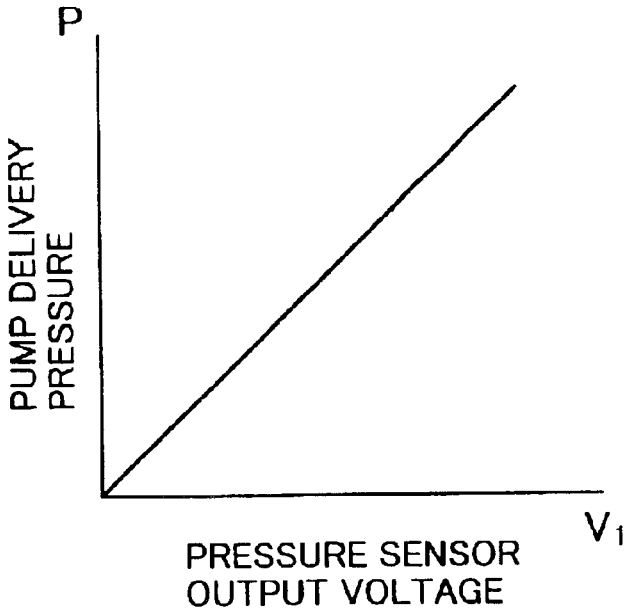
FIG. 5 shows a conversion map of a detected voltage of a pressure sensor shown in FIG. 2 and a pressure stored in the ROM of the controller shown in FIG. 3.

FIG. 5 shows a conversion map for conversion from an output voltage V1 of the pressure sensor 221*a* led from the measuring units 21 to 26 via the signal lines 121 to 126 to a pressure value (pump delivery pressure) P. The relationship between the output voltage V1 and pressure value P is set such that the pressure value P increases as the output voltage V1 increases.

Figure 6:
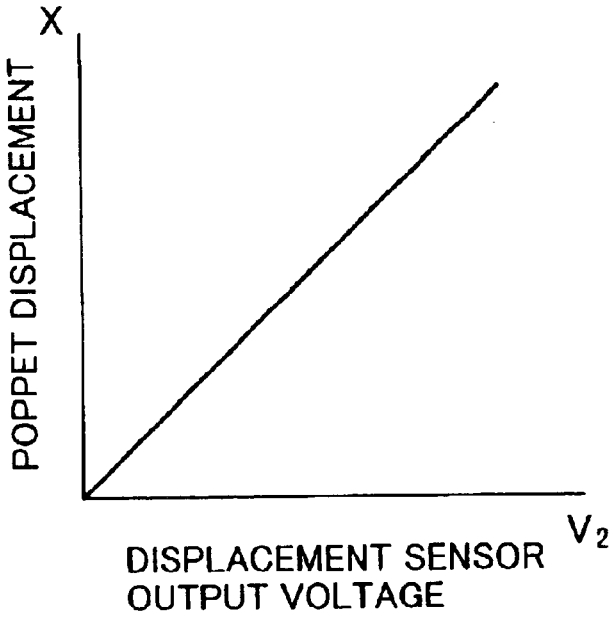
FIG. 6 shows a conversion map of a detected voltage of a displacement sensor shown in FIG. 2 and a poppet displacement stored in the ROM of the controller shown in FIG. 3.

FIG. 6 shows a conversion map for conversion from an output voltage V2 of the displacement sensor 221*b* led from the measuring units 21 to 26 via the signal lines 121 to 126 to a poppet displacement x. The relationship between the output voltage V2 and poppet displacement x is set such that the poppet displacement x increases as the output voltage V2 increases.

Figure 7:
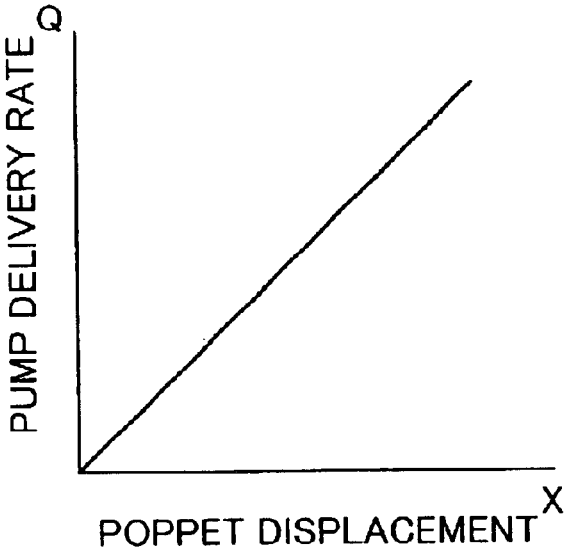
FIG. 7 shows a conversion map of a poppet displacement shown in FIG. 5 and a poppet flow rate (pump delivery rate) stored in the ROM of the controller shown in FIG. 3.

FIG. 7 shows a conversion map for conversion from the poppet displacement x converted by the conversion map shown in FIG. 6 to a flow rate value (pump delivery rate) Q. The relationship between the poppet displacement x and flow rate value Q is set such that the flow rate value Q increases as the poppet displacement x increases.

Figure 8:
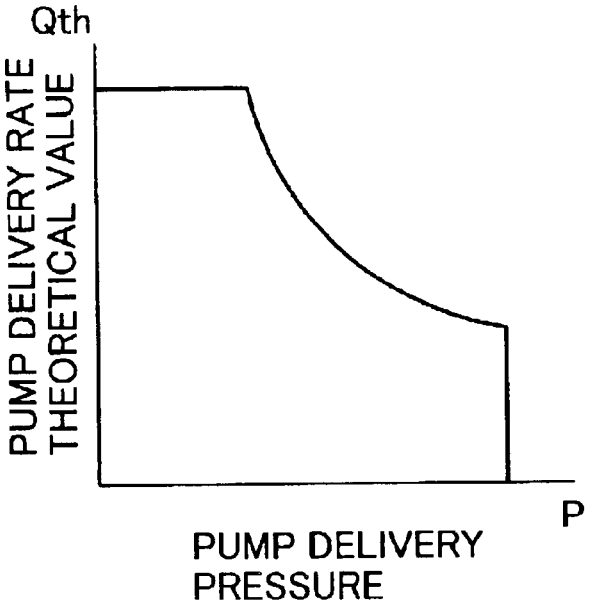
FIG. 8 shows a conversion map of a pump delivery pressure and a pump delivery rate theoretical value stored in the ROM of the controller shown in FIG. 3.

FIG. 8 shown a conversion map for conversion from the pump delivery pressure P converted by the conversion map shown in FIG. 5 to a pump delivery rate theoretical value Qth used for pump fault decision processing. This conversion map corresponds to a horsepower limiting control characteristic when the input torque limiting control shown in FIG. 4 is performed at a predetermined engine speed, for example, a maximum rated engine speed and the relationship between the pump delivery pressure P and pump delivery rate theoretical value Qth is set such that when the pump delivery pressure increases, the product (consumed horsepower) of the pump delivery pressure P and pump delivery rate theoretical value Qth is kept constant match with the relationship shown in FIG. 4.

Then, the data collection processing program and decision output processing program stored in the area 53*b* and area 53*c* will be explained in detail by using FIG. 9 to FIG. 12.

The data collection processing of measured values from the measuring units 21 to 26 and the decision output processing are the same in content for each unit and the data collection processing of measured values from the measuring unit 21 and the decision output processing will be explained in detail by way of an example.

Figure 9:
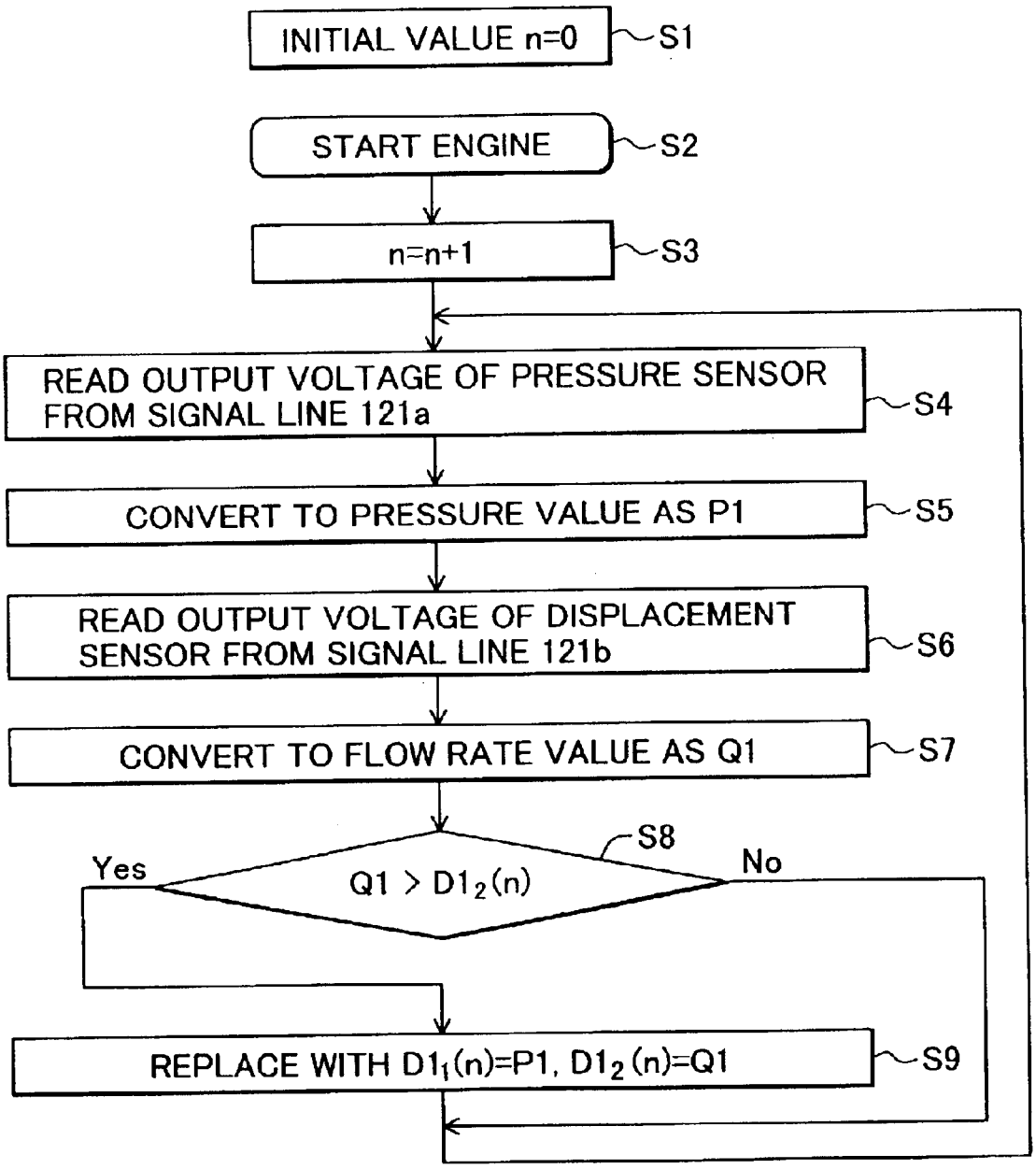
FIG. 9 shows a flow chart of a data collection processing program stored in the ROM of the controller shown in FIG. 3.

FIG. 9 shows a flow chart of the data collection processing program. As an initial setting of the data collection processing program, the initial value of a processing count n at the time of mounting of the controller 50 is set to 0 (S1). The data collection processing program performs one processing of data collection from start to stop of the engine.

First, the data collection processing program is started when the engine starts (S2), and adds 1 to the past data collection processing count (number of times of engine start) n to set a new nth processing (S3). As processing of the measured data, the output value of the pressure sensor 221*a* is read from the signal line 121*a* at first (S4) and then converted to a pressure value P1 by the conversion map shown in FIG. 5 (S5). Next, the output value of the displacement sensor 221*b* is read by the signal line 121*b* (S6) and then converted to a flow rate value Q1 by the conversion map shown in FIG. 6 and FIG. 7 (S7). These pressure value P1 and flow rate value Q1 are the values detected when the hydraulic excavator is actually operated, the hydraulic excavator being the working machine on which the hydraulic drive system shown in FIG. 1 is mounted. Then, the flow rate value Q1 is compared with $D1_2(n)$ which is the maximum value of the flow rate value Q1 stored in the past (S8), and if the flow rate value Q1 is greater than $D1_2(n)$, the read pressure value P1 is replaced with $D1_1(n)$ which is the pressure value P1 stored in the past and the flow rate value Q1 is replaced with $D1_2(n)$ (S9). This processing in S4 to S9 is repeated until the engine stops.

From above, at the data collection processing count n, data of the pressure value $D1_1(n)$ and flow rate value $D1_2(n)$ when the hydraulic pump 1 delivers a maximum flow rate are obtained.

Figure 10:
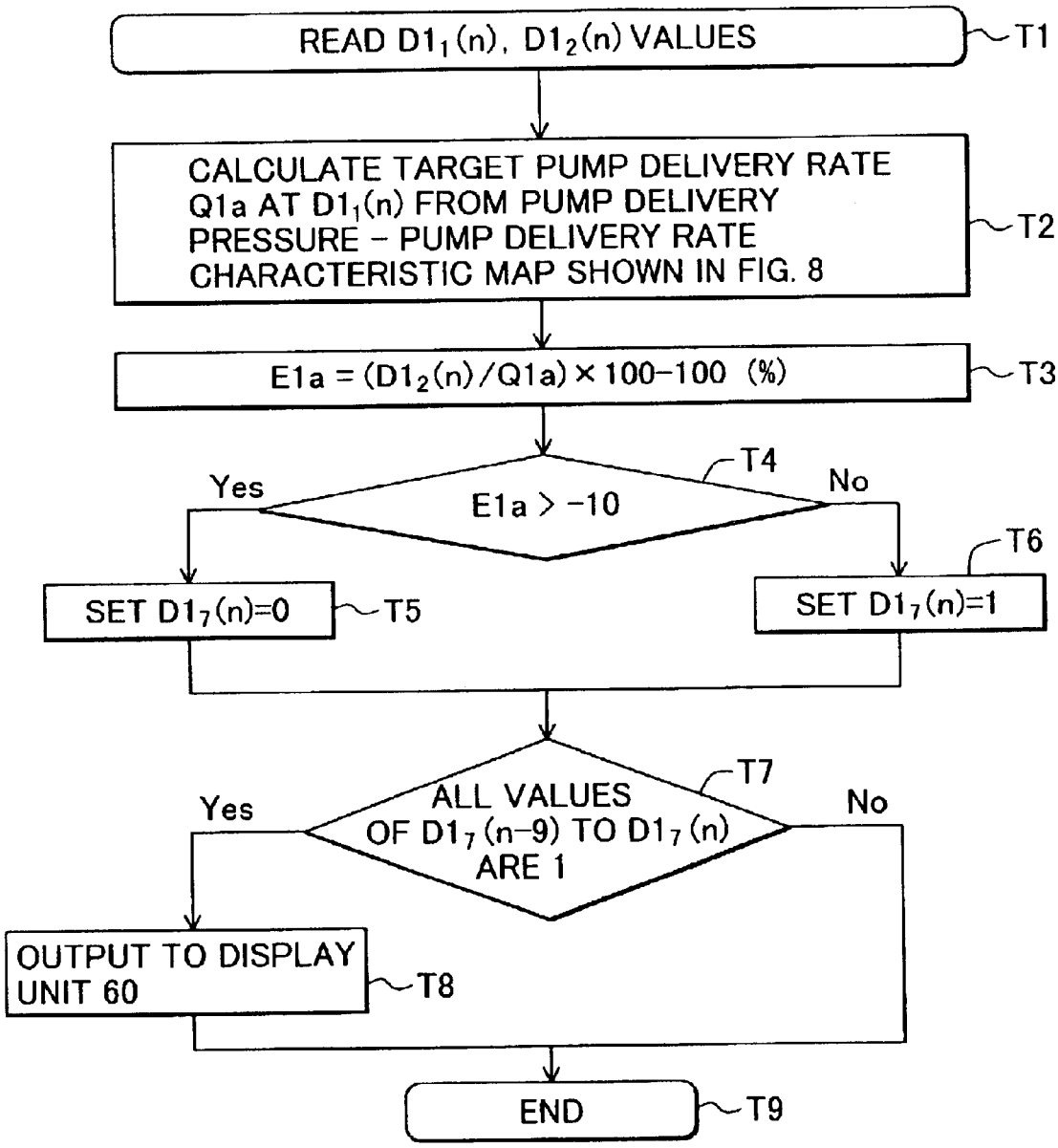
FIG. 10 shows a flow chart of a decision output processing program stored in the ROM of the controller shown in FIG. 3.

FIG. 10 shows a flow chart of a decision output processing program. In this decision output processing program, the values $D1_1(n)$ and $D1_2(n)$ at the data collection processing count n are read to start the processing at first (T1). Then, a target pump delivery rate theoretical value Q1*a* at the pressure value $D1_1(n)$ is calculated according to the pump delivery pressure P-pump delivery rate theoretical value Qth conversion map shown in FIG. 8 (T2). Then, the percentage representing the deviation of the actual pump delivery rate $D1_2(n)$ from this calculated target pump delivery rate theoretical value Q1*a* is calculated from the following expression to calculate a value of E1*a* (T3).

$$E1a=(D1_2(n)/Q1a)\times 100-100(\%)$$

Then, it is decided whether the calculated E1*a* value is greater than −10% or not (whether the actual pump delivery rate $D1_2(n)$ is different from the target pump delivery rate theoretical value Q1*a* by −10% or more) (T4). If the E1*a* value is greater than −10%, a value of $D1_7(n)$ is set to 0 (T5). If the E1*a* value is smaller than −10%, the $D1_7(n)$ value is set to 1 (T6). In this way, the decision result at the data collection processing count n is stored as the $D1_7(n)$ value being 0 or 1.

Then, a fault decision on the hydraulic pump 1 is made (T7). In this fault decision, the 10 decision results from the past data collection processing count (n−9) to n as shown in FIG. 11 are read, and it is decided whether all the values $D1_7(n-9)$ to $D1_7(n)$ decided in step T4 are 1 or not and if all the values are 1 (T7), the hydraulic pump 1 is decided to be faulty and a signal is output to the display unit 60 through the signal line 161 (T8).

Figures 11, 12:
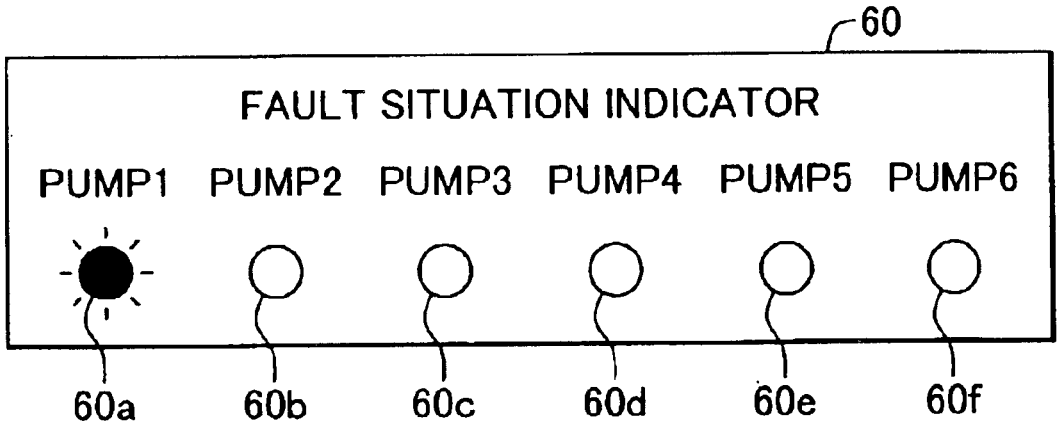
FIG. 11 illustrates a data storage situation used in the decision processing program shown in FIG. 10.
FIG. 12 is a detail view of the display unit shown in FIG. 1.

FIG. 12 shows an example of the display unit 60. The display unit 60 includes six lamps 60*a* to 60*f* that correspond to the hydraulic pumps 1 to 6, respectively, and if it is decided that any of the hydraulic pumps 1 to 6 is faulty, the lamp corresponding to the faulty hydraulic pump turns ON. In the above example, if the hydraulic pump 1 is decided to be faulty, the lamp 60*a* corresponding to the hydraulic pump 1 is turned on by a signal output to the display unit 60 through the signal line 161. Furthermore, the display unit 60 may also be provided with a monitor unit to display the data in FIG. 11 by the request of the operator.

Figure 13:
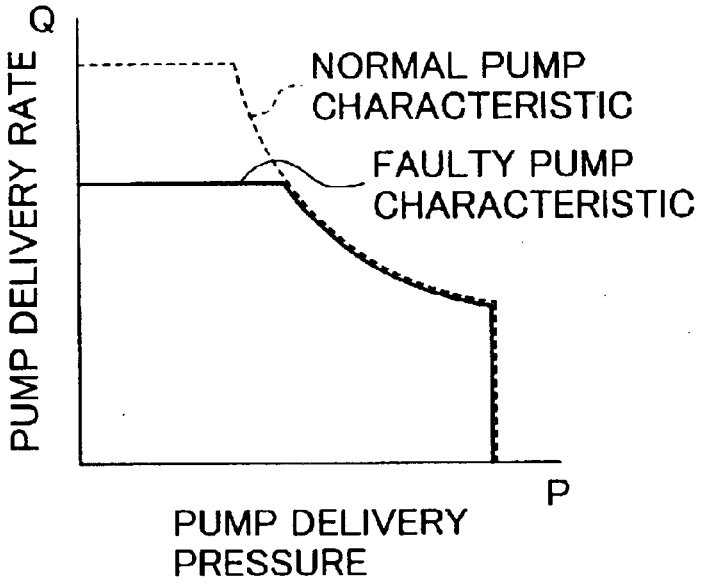
FIG. 13 illustrates a fault example of a hydraulic pump detected by the decision processing program shown in FIG. 10.
Figure 14:
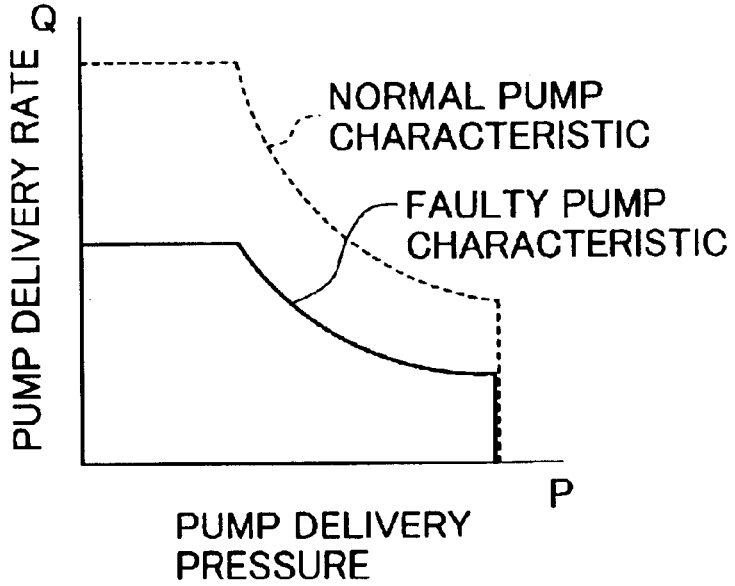
FIG. 14 illustrates another fault example of a hydraulic pump detected by the decision processing program shown in FIG. 10.

FIG. 13 and FIG. 14 show fault examples of the hydraulic pump 1 detected by this embodiment.

When the hydraulic pump 1 is functioning normally, the maximum delivery rate of the hydraulic pump 1 is limited by horsepower limiting control of the above-described controller 50 and the pump delivery pressure-pump delivery rate characteristic (hereinafter referred to as "PQ characteristic") at this time is expressed by dotted line in FIG. 13 and FIG. 14. This corresponds to the pump delivery pressure P—pump delivery rate theoretical value Qth conversion map shown in FIG. 8. However, in the case of a fault where there is a problem with the tilting mechanism of the hydraulic pump 1 and the hydraulic pump 1 fails to reach the maximum tilting position and the pump delivery rate remains insufficient, the PQ characteristic of the hydraulic pump 1 becomes a characteristic as shown with solid line in FIG. 13. Furthermore, in the case of a fault where there is a problem with horsepower limiting control of the hydraulic pump 1 and the delivery rate of the hydraulic pump 1 does not reach a specified value of horsepower limiting control over the entire pump delivery pressure and remains insufficient, the PQ characteristic of the hydraulic pump 1 becomes a characteristic as shown with solid line in FIG. 14.

In the flow chart shown in FIG. 10, when such a fault of the hydraulic pump 1 occurs, the E1*a* value is decided to be smaller than −10% in step T4 and the $D1_7(n)$ value is set to 1 in step T6. Then, when the same decision result is obtained through 10 data collection processings consecutively, it is decided that the hydraulic pump 1 is faulty and the corresponding lamp of the display unit 60 is turned on.

As shown above, according to this embodiment, it is possible to detect a fault by automatically determining which of the hydraulic pumps 1 to 6 has a problem during an actual operation of the working machine and further to detect a fault when there is any problem with horsepower limiting control of the hydraulic pumps 1 to 6.

Furthermore, when the display unit 60 is provided with a monitor unit to be able to display the data in FIG. 11, it is possible to grasp the fault situation of the hydraulic pumps from the data and take action quickly.

Furthermore, it is possible to detect faults of the hydraulic pump such as a fault where there is a problem with the tilting mechanism of the hydraulic pump and the hydraulic pump fails to reach a maximum tilting position or a fault where there is a problem with horsepower limiting control of the hydraulic pump and the delivery rate of the hydraulic pump as a whole does not reach a specified value of horsepower limiting control.

A second embodiment of the present invention will be explained by using FIG. 1 to FIG. 8 and FIG. 15 to FIG. 18. In this embodiment, the structures of the hydraulic drive system and the controller to which the pump fault diagnostic apparatus relates is the same as those of the first embodiment, but the information used for detecting the state of the hydraulic pump during an actual operation differs from the first embodiment.

In this embodiment, a data collection processing program for collecting measured values from the measuring units 21 to 26 and a decision output processing program are stored in the areas 53*b* and 53*c* of the controller ROM 53 shown in FIG. 3 as in the case of the first embodiment. These processings as the same in content for each unit and the data collection processing of measured values from the measuring unit 21 and the decision output processing will be explained in detail by way of an example.

Figure 15:
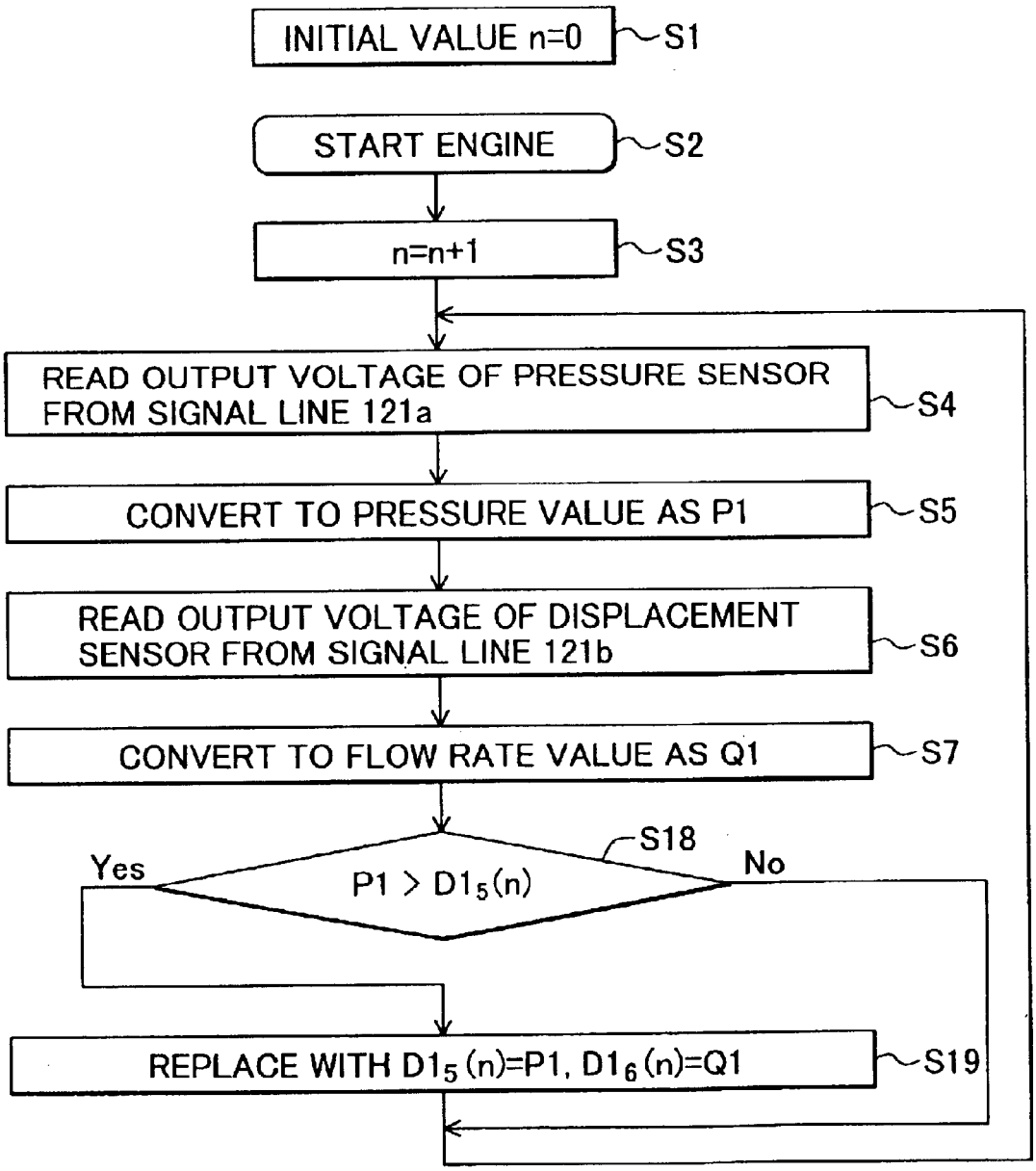
FIG. 15 shows a flow chart of a data collection processing program of a pump fault diagnostic apparatus according to a second embodiment of the present invention.

FIG. 15 shows a flow chart of a data collection processing program of the pump fault diagnostic apparatus according to this embodiment. The same steps as those shown in FIG. 9 are designated with the same reference numerals.

In FIG. 15, as in the case of the first embodiment shown in FIG. 9, a pressure value P1 and a flow rate value Q1 are detected during an actual operation of the hydraulic excavator provided with the hydraulic drive system (S1 to S7). Then, from the pressure value P1 and flow rate value Q1 detected during the actual operation, the pressure value P1 is compared with $D1_5(n)$ which is the maximum value of the pressure value P1 stored in the past (S18), and if the pressure value P1 is greater than $D1_5(n)$, the read pressure value P1 is replaced with $D1_5(n)$ and the flow rate value Q1 is replaced with $D1_6(n)$ which is the flow rate value Q1 stored in the past (S19). The processing in these S4 to S19 is repeated until the engine stops.

From above, at the data collection processing count n, data of the pressure value $D1_5(n)$ and flow rate value $D1_6(n)$ when the hydraulic pump 1 delivers a maximum pressure are obtained.

Figure 16:
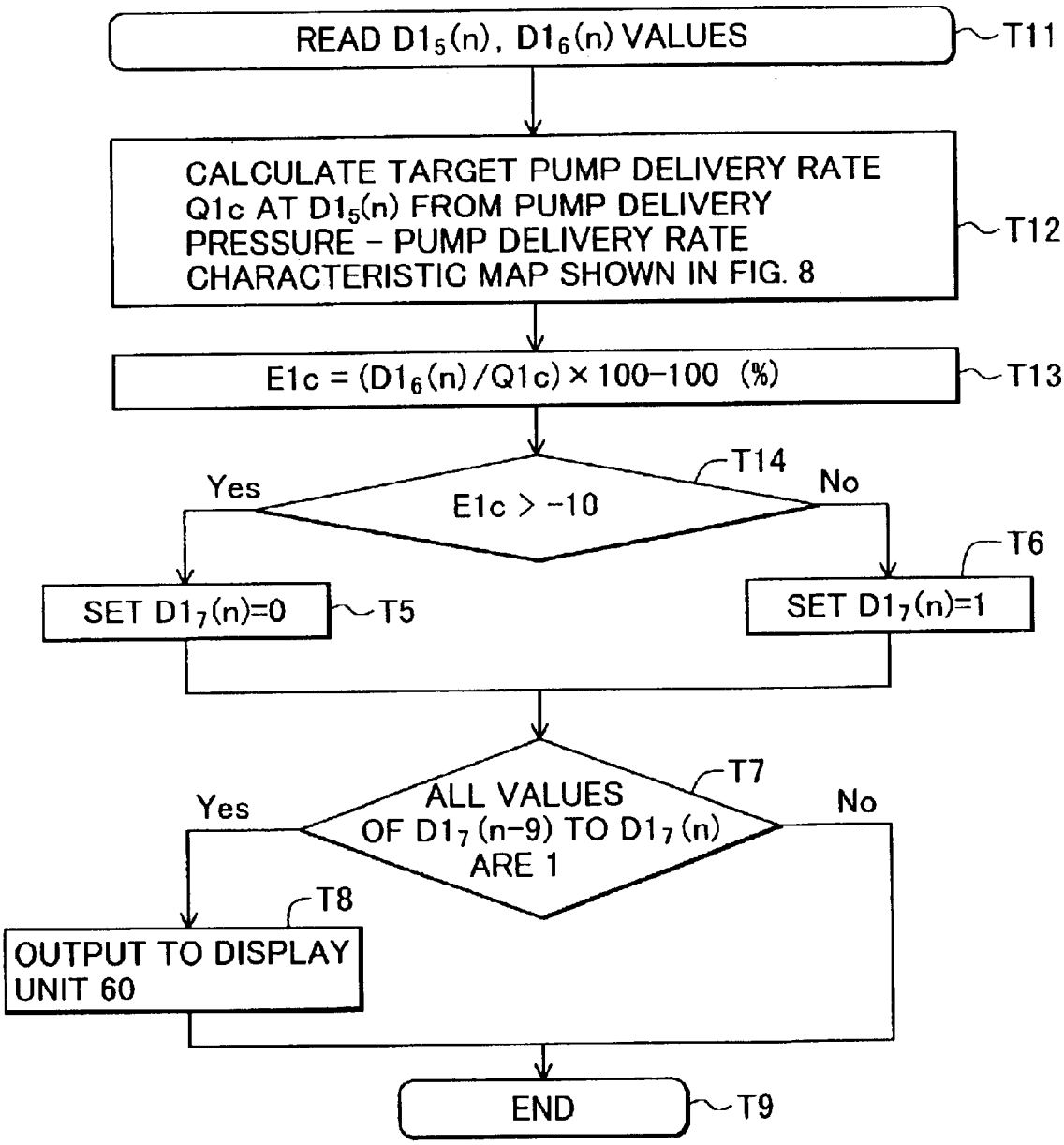
FIG. 16 shows a flow chart of a decision output processing program of a pump fault diagnostic apparatus according to the second embodiment of the present invention.

FIG. 16 shows a flow chart of a decision output processing program. The same steps as those shown in FIG. 10 are designated with the same reference numerals.

In this decision output processing program shown in FIG. 16, the values $D1_5(n)$ and $D1_6(n)$ at the data collection processing count n are read to start the processing at first (T11). Then, a target pump delivery rate Q1*c* at the pressure value $D1_5(n)$ is calculated according to the pump delivery pressure-pump delivery rate theoretical value Qth conversion map shown in FIG. 8 (T12). Then, the percentage representing the deviation of the actual pump delivery rate $D1_6(n)$ from this calculated target pump delivery rate theoretical value Q1*c* is calculated from the following expression to calculate E1*c* (T13).

$$E1c=(D1_6(n)/Q1c)\times 100-100(\%)$$

Then, it is decided whether the calculated E1*c* value is greater than −10% or not (whether the actual pump delivery rate $D1_6(n)$ is different from the target pump delivery rate theoretical value by −10% or more) (T14). If the E1*c* value is greater than −10%, a value of $D1_7(n)$ is set to 0 (T5). If the E1*c* value is smaller than −10%, the $D1_7(n)$ value is set to 1 (T6). In this way, the decision result at the data collection processing count n is stored as the $D1_7(n)$ value being 0 or 1.

Then, a fault decision on the hydraulic pump 1 is made (T7). In this fault decision, the 10 decision results from the past data collection processing count (n−9) to n as shown in FIG. 17 are read, and it is decided whether all the values $D1_7(n-9)$ to $D1_7(n)$ decided in step T14 are 1 or not and if all the values are 1 (T7), the hydraulic pump 1 is decided to be faulty and a signal is output to the display unit 60 through the signal line 161 (T8). The display unit 60 turns on the corresponding lamp as in the case of the first embodiment. Furthermore, the display unit 60 may also be provided with a monitor unit to display the data in FIG. 11 by the request of the operator in this case, too.

As a fault example of the hydraulic pump 1 detected by this embodiment, there is a fault where there is a problem with horsepower limiting control of the hydraulic pump and the delivery rate of the hydraulic pump 1 does not reach a specified value of horsepower limiting control throughout the pump delivery pressure and remains insufficient as shown with solid line in the aforementioned FIG. 14. When such a fault of the hydraulic pump 1 occurs, it is decided in step T14 that the E1*c* value is smaller than −10% and the value $D1_7(n)$ is set to 1 in step T6. Then, when the same decision result is obtained through 10 data collection processings consecutively, it is decided that the hydraulic pump 1 is faulty and the corresponding lamp of the display unit 60 is turned on.

Figure 18:
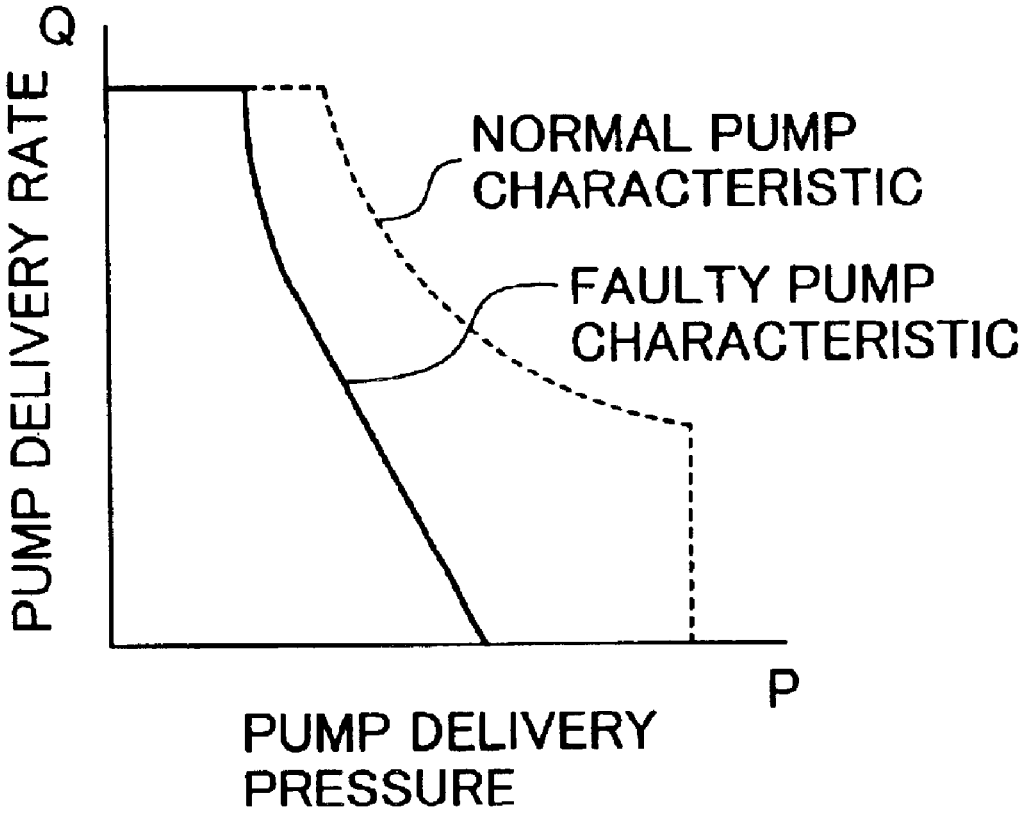
FIG. 18 illustrates a fault example of a hydraulic pump detected by the decision processing program shown in FIG. 16.

As another fault example of the hydraulic pump 1 detected by this embodiment, there is a fault shown with solid line in FIG. 18. This is a case where the delivery rate of the hydraulic pump 1 does not reach a specified value of horsepower limiting control when the delivery pressure of the hydraulic pump 1 increases and the delivery rate remains insufficient. Even if such a fault occurs, it is decided in step T14 that the E1*c* value is smaller than −10% and the value $D1_7(n)$ is set to 1 in step T6. Then, when the same decision result is obtained through 10 data collection processings consecutively, it is decided that the hydraulic pump 1 is faulty and the corresponding lamp of the display unit 60 is turned on.

As shown above, according to this embodiment, it is also possible to detect a fault by automatically determining which of the hydraulic pumps 1 to 6 has a problem during an actual operation of the working machine and further to detect a fault when there is any problem with horsepower limiting control of the hydraulic pumps 1 to 6.

Furthermore, it is possible to detect faults of the hydraulic pump such as a fault where there is a problem with horsepower limiting control of the hydraulic pump and the delivery rate of the hydraulic pump as a whole does not reach a specified value of horsepower limiting control or a fault where the delivery rate of the hydraulic pump does not reach a specified value of horsepower limiting control when the delivery pressure of the hydraulic pump increases.

A third embodiment of the present invention will be explained by using FIG. 1 to FIG. 8 and FIG. 19 to FIG. 21. In this embodiment, the structure of the hydraulic drive system and the controller to which the pump fault diagnostic apparatus relates is the same as those of the first embodiment, but the information used for detecting the state of the hydraulic pump during an actual operation differs from the first and the second embodiments.

In this embodiment, a data collection processing program for collecting measured values from the measuring units 21 to 26 and a decision output processing program are stored in the areas 53*b* and 53*c* of the controller ROM 53 shown in FIG. 3 as in the case of the first embodiment. These processings are the same in content for each unit and the data collection processing of measured values from the measuring unit 21 and the decision output processing will be explained in detail by way of an example.

Figure 19:
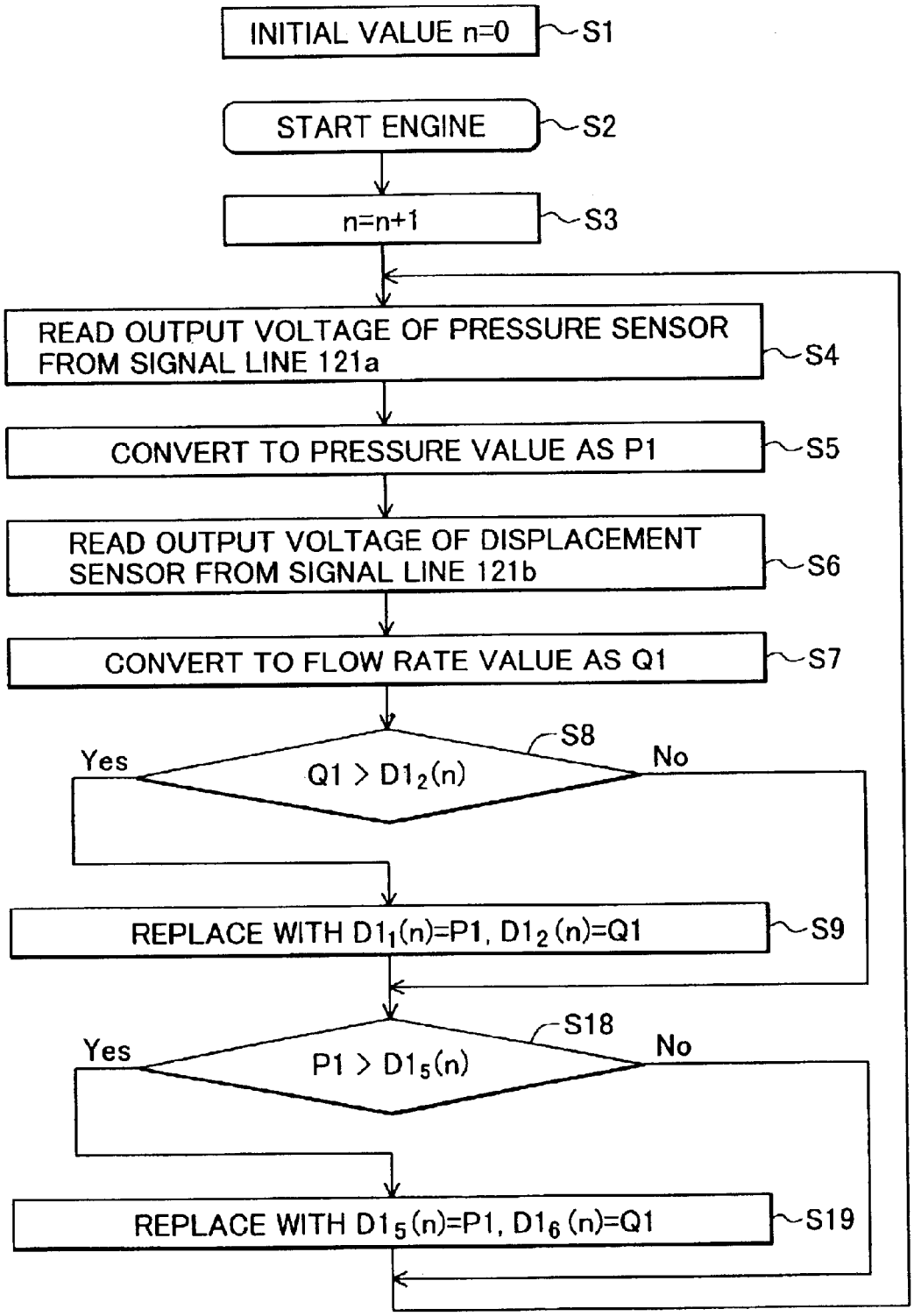
FIG. 19 shows a flow chart of a data collection processing program of a pump fault diagnostic apparatus according to a third embodiment of the present invention.

FIG. 19 shows a flow chart of a data collection processing program of the pump fault diagnostic apparatus according to this embodiment. The same steps as those shown in FIG. 9 and FIG. 15 are designated with the same reference numerals.

In FIG. 19, as in the case of the embodiments shown in FIG. 9 and FIG. 15, a pressure value P1 and a flow rate value Q1 are detected during an actual operation of the hydraulic excavator provided with the hydraulic drive system (S1 to S7). Then, the flow rate value Q1 detected during the actual operation is compared with $D1_2(n)$ which is the maximum value of the flow rate value Q1 stored in the past (S8), and if the flow rate value Q1 is greater than $D1_2(n)$, the read pressure value P1 is replaced with $D1_1(n)$ which is the pressure value P1 stored in the past and the flow rate value Q1 is replaced with $D1_2(n)$ (S9). Then, from the pressure value P1 and flow rate value Q1 detected during the actual operation, the pressure value P1 is compared with $D1_5(n)$ which is the maximum value of the pressure value P1 stored in the past (S18), and if the pressure value P1 is greater than $D1_5(n)$, the read pressure value P1 is replaced with $D1_5(n)$ and the flow rate value Q1 is replaced with $D1_6(n)$ which is the flow rate value Q1 stored in the past (S19). The processing in these S4 to S19 is repeated until the engine stops.

From above, at the data collection processing count n, data of the pressure value $D1_1(n)$ and flow rate value $D1_2(n)$ when the hydraulic pump 1 delivers a maximum flow rate and data of the pressure value $D1_5(n)$ and flow rate value $D1_6(n)$ when the hydraulic pump 1 delivers a maximum pressure are obtained.

Figure 20:
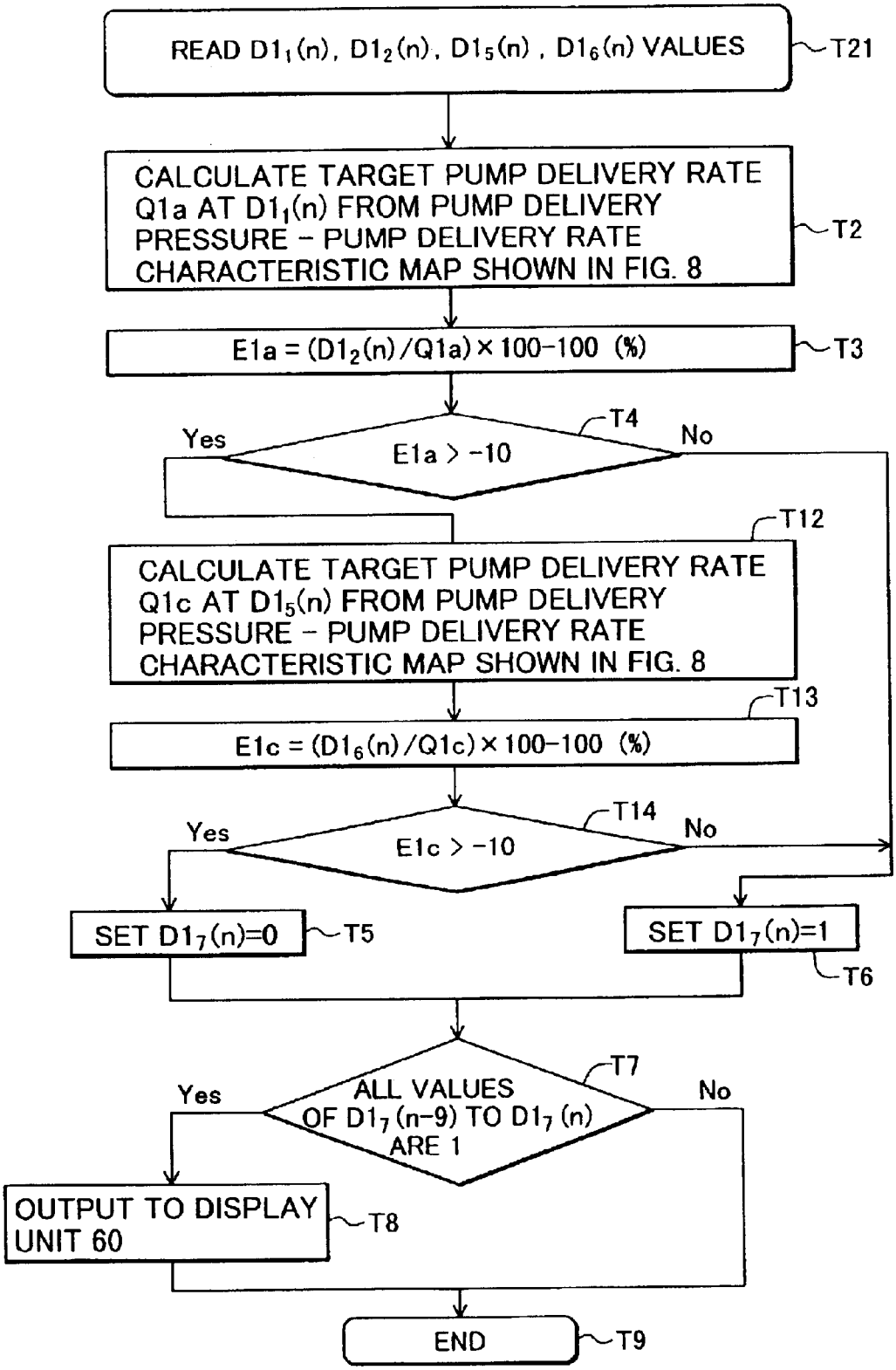
FIG. 20 shows a flow chart of a decision output processing program of the pump fault diagnostic apparatus according to the third embodiment of the present invention.

FIG. 20 shows a flow chart of a decision output processing program. The same steps as those shown in FIG. 10 and FIG. 16 are designated with the same reference numerals.

In this decision output processing program shown in FIG. 20, the values $D1_1(n)$ and $D1_2(n)$ and the values $D1_5(n)$ and $D1_6(n)$ at the data collection processing count n are read to start the processing at first (T21). Then, a target pump delivery rate theoretical value Q1*a* at the pressure value $D1_1(n)$ is calculated according to the pump delivery pressure P—pump delivery rate theoretical value Qth conversion map shown in FIG. 8 (T2). Then, the percentage representing the deviation of the actual pump delivery rate $D1_2(n)$ from this calculated target pump delivery rate theoretical value Q1*a* is calculated from the following expression to calculate E1*a* (T3).

$$E1a=(D1_2(n)/Q1a)\times 100-100(\%)$$

Then, it is decided whether the calculated E1*a* value is greater than −10% or not (whether the actual pump delivery rate $D1_2(n)$ is different from the target pump delivery rate theoretical value Q1*a* by −10% or more) (T4). If the E1*a* value is greater than −10%, the target pump delivery rate Q1*c* at the pressure value $D1_5(n)$ is calculated from the pump delivery pressure—pump delivery rate theoretical value Qth conversion map shown in FIG. 8 (T12). Then, the percentage representing the deviation of the actual pump delivery rate $D1_6(n)$ from this calculated target pump delivery rate theoretical value Q1*c* is calculated from the following expression to calculate E1*c* (T13).

$$E1c=(D1_6(n)/Q1c)\times 100-100(\%)$$

Then, it is decided whether the calculated E1*c* value is greater than −10% or not (whether the actual pump delivery rate $D1_6(n)$ is different from the target pump delivery rate theoretical value by −10% or more) (T14). If the E1*c* value is greater than −10%, a value of $D1_7(n)$ is set to 0 (T5). If at least one of the E1*a* or E1*c* value is smaller than −10%, the $D1_7(n)$ value is set to 1 (T6). In this way, the decision result at the data collection processing count n is stored as the $D1_7(n)$ value being 0 or 1.

Then, a fault decision on the hydraulic pump 1 is made (T7). In this fault decision, the 10 decision results from the past data collection processing count (n−9) to n as shown in FIG. 21 are read, and it is decided whether all the values $D1_7(n-9)$ to $D1_7(n)$ decided in steps T4 and T14 are 1 or not (T7) and if all the values are 1, the hydraulic pump 1 is decided to be faulty and a signal is output to the display unit 60 through the signal line 161 (T8). The display unit 60 turns on the corresponding lamp as in the case of the first embodiment. Furthermore, the display unit 60 may also be provided with a monitor unit to display the data in FIG. 11 by the request of the operator in this case, too.

In this embodiment configured as described above, as in the first embodiment, it is possible by step T4, T6, T7 and T8 to detect the above-mentioned fault where the hydraulic pump 1 does not reach the maximum tilting position and the pump delivery rate remains insufficient as shown with solid line in FIG. 13, the above-mentioned fault where the delivery rate of the hydraulic pump 1 does not reach a specified value of horsepower limiting control and remains insufficient throughout the entire range of the delivery pressure of the hydraulic pump 1, as shown with solid line in FIG. 14. Also, as in the second embodiment, it is possible by step T14, T6, T7 and T8 to detect the above-mentioned fault where the delivery rate of the hydraulic pump 1 does not reach a specified value of horsepower limiting control and remains insufficient throughout the entire range of the delivery pressure of the hydraulic pump 1 as shown with solid line in FIG. 14 and the above-mentioned fault where the delivery rate of the hydraulic pump 1 does not reach a specified value of horsepower limiting control and remains insufficient when the delivery pressure of the hydraulic pump 1 is high as shown with solid line in FIG. 18.

As shown above, according to this embodiment, it is also possible to detect a fault by automatically determining which of the hydraulic pumps 1 to 6 has a problem during an actual operation of the working machine and further to detect a fault when there is any problem with horsepower limiting control of the hydraulic pumps 1 to 6.

Furthermore, it is possible to detect faults of the hydraulic pump such as a fault where there is a problem with the tilting mechanism of the hydraulic pump and the hydraulic pump fails to reach the maximum tilting position, or a fault where there is a problem with horsepower limiting control of the hydraulic pump and the delivery rate of the hydraulic pump as a whole does not reach a specified value of horsepower limiting control, or a fault where the delivery rate of the hydraulic pump does not reach a specified value of horsepower limiting control when the delivery pressure of the hydraulic pump increases.

A fourth embodiment of the present invention will be explained by using FIG. 1 to FIG. 8 and FIG. 22 to FIG. 24. In this embodiment, the structures of the hydraulic .drive system and the controller to which the pump fault diagnostic apparatus relates is the same as those of the first embodiment, but information of the pump delivery rate at an intermediate delivery pressure is added to the third embodiment as information used for detecting the state of the hydraulic pump during an actual operation.

In this embodiment, a data collection processing program for collecting measured values from the measuring units 21 to 26 and a decision output processing program are stored in the areas 53*b* and 53*c* of the controller ROM 53 shown in FIG. 3 as in the case of the first embodiment. These processings are the same in content for each unit and the data collection processing of measured values from the measuring unit 21 and the decision output processing will be explained in detail by way of an example.

Figure 22:
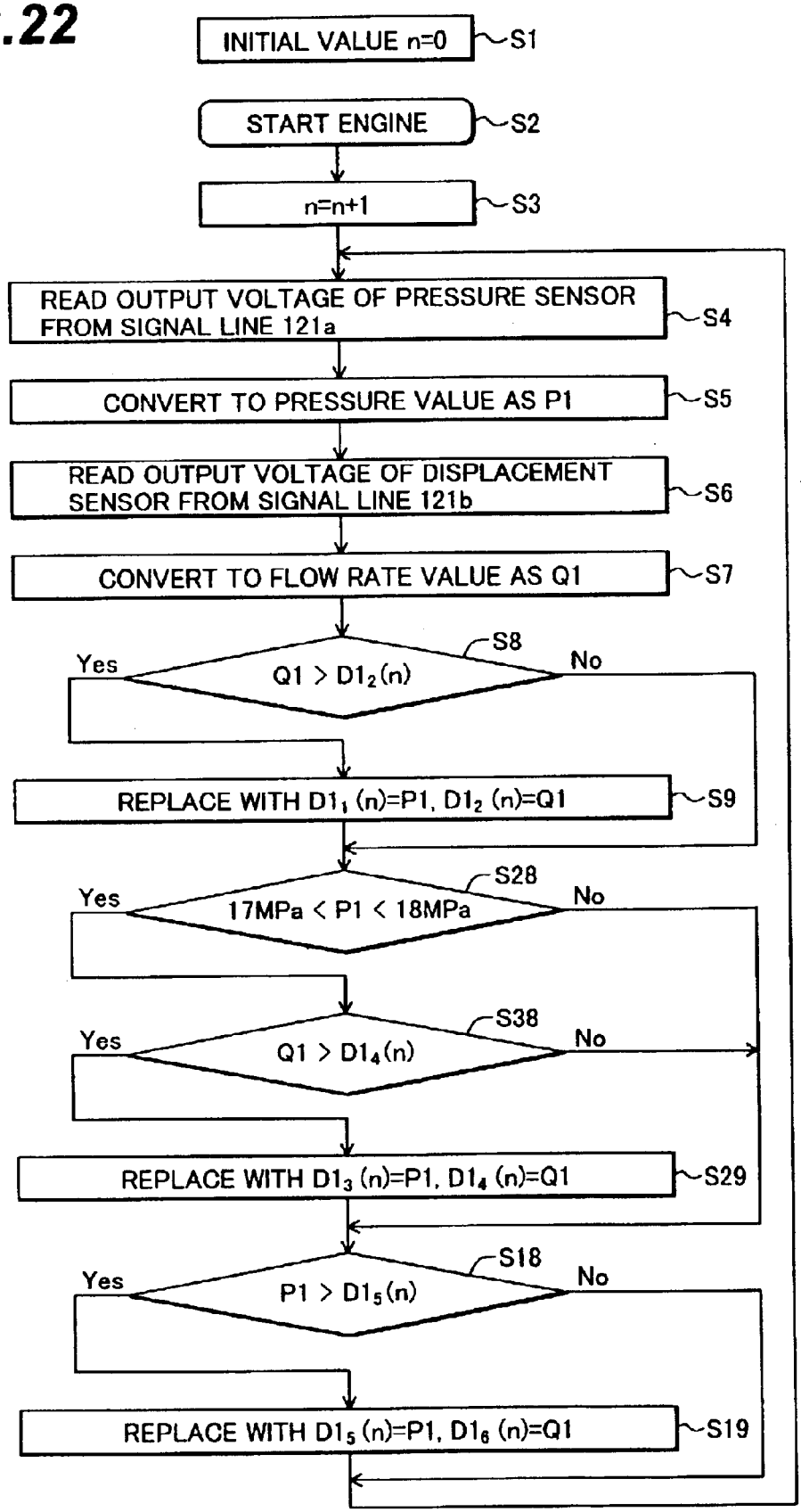
FIG. 22 shows a flow chart of a data collection processing program of a pump fault diagnostic apparatus according to a fourth embodiment of the present invention.

FIG. 22 shows a flow chart of a data collection processing program of the pump fault diagnostic apparatus according to this embodiment. The same steps as those shown in FIG. 9, FIG. 15 and FIG. 19 are designated with the same reference numerals.

In FIG. 22, as in the case of the embodiment shown in FIG. 19, a pressure value P1 and a flow rate value Q1 are detected during an actual operation of the hydraulic excavator provided with the hydraulic drive system (S1 to S7). Then, the data of a pressure value $D1_1(n)$ and a flow rate value $D1_2(n)$ when the hydraulic pump 1 delivers a maximum flow rate are collected (S8, S9). Then, it is decided whether the pressure value P1 is an intermediate pressure of the hydraulic pump 1 or not (S28). For example, when the maximum delivery pressure of the hydraulic pump 1 is 35 MPa, its intermediate pressure is 17.5 MPa, and therefore it is decided whether the pressure value P1 falls within the range of 17 MPa to 18 MPa or not. If the pressure value P1 is an intermediate pressure, the flow rate value Q1 is compared with $D1_4(n)$ which is the maximum value of the flow rate value Q1 at the intermediate pressure stored in the past (S38), and if the flow rate value Q1 is greater than $D1_4(n)$, the read pressure value P1 is replaced with $D1_3(n)$, and the flow rate value Q1 is replaced with $D1_4(n)$ (S29). Furthermore, the pressure value P1 is compared with $D1_5(n)$ which is the maximum value of the pressure value P1 stored in the past (S18), and if the pressure value P1 is greater than $D1_5(n)$, the read pressure value P1 is replaced with $D1_5(n)$ and the flow rate value Q1 is replaced with $D1_6(n)$ which is the flow rate value Q1 stored in the past (S19). The processing in these S4 to S19 is repeated until the engine stops.

From above, at the data collection processing count n, data of the pressure value $D1_1(n)$ and flow rate value $D1_2(n)$ when the hydraulic pump 1 delivers a maximum flow rate and data of the pressure value $D1_5(n)$ and flow rate value $D1_6(n)$ when the hydraulic pump 1 delivers a maximum pressure as well as data of the pressure value $D1_3(n)$ and flow rate value $D1_4(n)$ when the hydraulic pump 1 delivers a maximum flow rate at an intermediate dilivery pressure.

Figure 23:
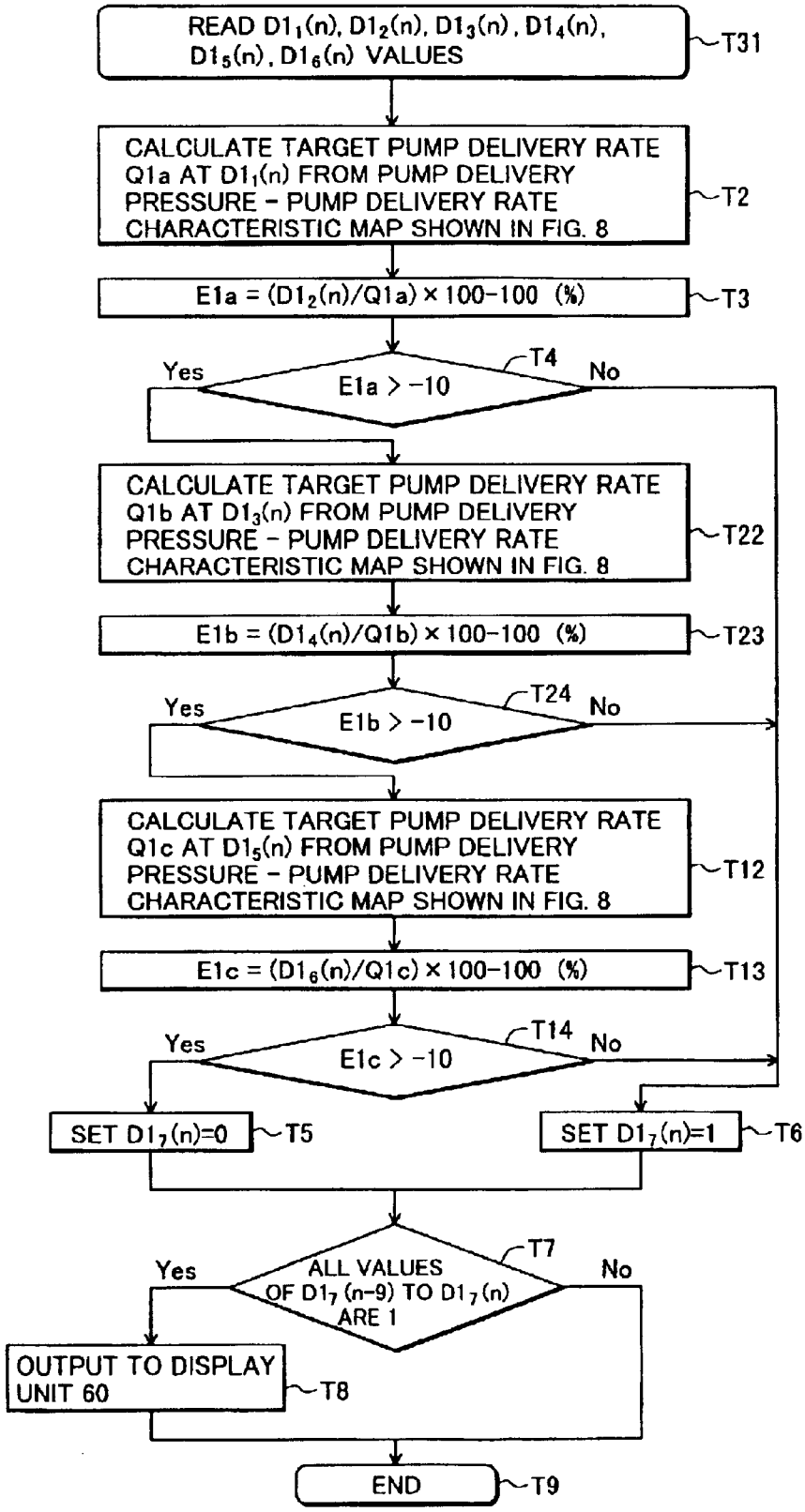
FIG. 23 shows a flow chart of a decision output processing program of the pump fault diagnostic apparatus according to the fourth embodiment of the present invention.

FIG. 23 shows a flow chart of a decision output processing program. The same steps as those shown in FIG. 10, FIG. 16 and FIG. 20 are designated with the same reference numerals.

In this decision output processing program shown in FIG. 23, the values $D1_1(n)$ and $D1_2(n)$, the values $D1_3(n)$ and $D1_4(n)$ and the values $D1_5(n)$ and $D1_6(n)$ at the data collection processing count n are read to start the processing at first (T31). In the subsequent procedure, the decision processing with the data of $D1_3(n)$ and $D1_4(n)$ is added to the decision output processing program shown in FIG. 20.

That is, if the calculated E1*a* value is greater by −10% or more in step T4, a target pump delivery rate theoretical value Q1*b* at the pressure value $D1_3(n)$ is calculated according to the pump delivery pressure-pump delivery rate theoretical value Qth conversion map shown in FIG. 8 (T22). Then, the percentage representing the deviation of the actual pump delivery rate $D1_4(n)$ from this calculated target pump delivery rate theoretical value Q1*b* is calculated from the following expression to calculate E1*b* (T23).

$$E1b=(D1_4(n)/Q1b)\times 100-100(\%)$$

Then, it is decided whether the calculated E1*c* value is greater than −10% or not (whether the actual pump delivery rate $D1_4(n)$ is different from the target pump delivery rate theoretical value Q1*b* by −10% or more) (T24). If the E1*b* value is greater than −10%, the process moves to steps T13 and T14 where it is decided whether the E1*c* value is greater than −10% or not (whether the actual pump delivery rate $D1_6(n)$ is different from the target pump delivery rate theoretical value Q1*c* by −10% or more) and if the E1*c* value is greater than −10%, the $D1_7(n)$ value is set to 0 (T5). On the other hand, if at least one of the E1*a* value, E1*b* value and E1*c* value is smaller than −10%, the $D1_7(n)$ value is set to 1 (T6). In this way, the decision result at the data collection processing count n is stored as the $D1_7(n)$ value being 0 or 1.

Then, a fault decision on the hydraulic pump 1 is made (T7). In this fault decision, the 10 decision results from the past data collection processing count (n−9) to n as shown in FIG. 24 are read, and it is decided whether all the values $D1_7(n-9)$ to $D1_7(n)$ decided in steps T4, T14 and T24 are 1 or not (T7) and if all the values are 1, the hydraulic pump 1 is decided to be faulty and a signal is output to the display unit 60 through the signal line 161 (T8). The display unit 60 turns on the corresponding lamp as in the case of the first embodiment. Furthermore, the display unit 60 may also be provided with a monitor unit to display the data in FIG. 11 by the request of the operator in this case, too.

In this embodiment configured as described above, as in the third embodiment, it is possible to detect faults of the hydraulic pump as shown with solid lines in FIG. 13, FIG. 14 and FIG. 18. Further, in this embodiment, it is possible also by step T24 to detect such a fault where the delivery rate of the hydraulic pump 1 does not reach a specified value of horsepower limiting control and remains insufficient as shown with solid line in FIG. 14 and FIG. 18.

As shown above, according to this embodiment, it is also possible to detect a fault by automatically determining which of the hydraulic pumps 1 to 6 has a problem during an actual operation of the working machine and further to detect a fault when there, is any problem with horsepower limiting control of the hydraulic pumps 1 to 6.

Furthermore, it is possible to detect faults of the hydraulic pump such as a fault where there is a problem with the tilting mechanism of the hydraulic pump and the hydraulic pump fails to reach the maximum tilting position, or a fault where there is a problem with horsepower limiting control of the hydraulic pump and the delivery rate of the hydraulic pump as a whole does not reach a specified value of horsepower limiting control, or a fault where the delivery rate of the hydraulic pump does not reach a specified value of horsepower limiting control when the delivery pressure of the hydraulic pump increases. Furthermore, it is possible to accurately detect a fault where there is a problem with horsepower limiting control of the hydraulic pumps 1 to 6.

Figure 25:
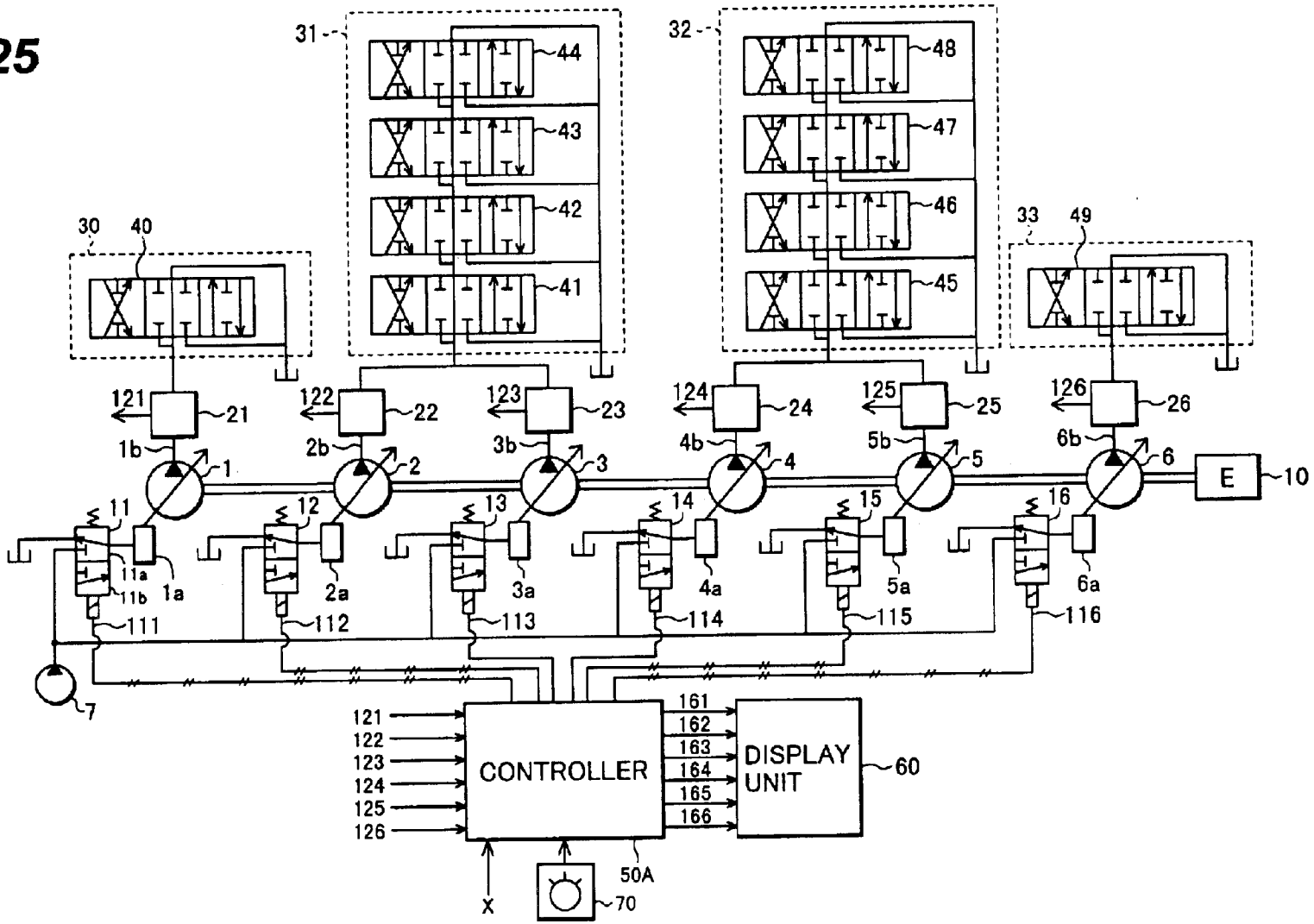
FIG. 25 illustrates a pump fault diagnostic apparatus according to a fifth embodiment of the present invention together with a hydraulic drive system equipped with the pump fault diagnostic apparatus.

A fifth embodiment of the present invention will be explained by using FIG. 4 to FIG. 8 and FIG. 25 to FIG. 28. This embodiment applies the present invention to a hydraulic drive system whose horsepower limiting control characteristic is made changeable by a mode changeover switch while allowing display of the level of a fault of the hydraulic pump. In FIG. 25, the same components as those in FIG. 1 are designated with the same reference numerals.

In FIG. 25, the hydraulic drive system to which this embodiment relates comprises a mode changeover switch 70 additionally to the first embodiment shown in FIG. 1 and a mode information signal of this mode changeover switch 70 is led to a controller 50A. The mode changeover switch 70 can be switched between three positions; normal mode position, fine operating mode position and heavy excavating mode position.

Figure 26:
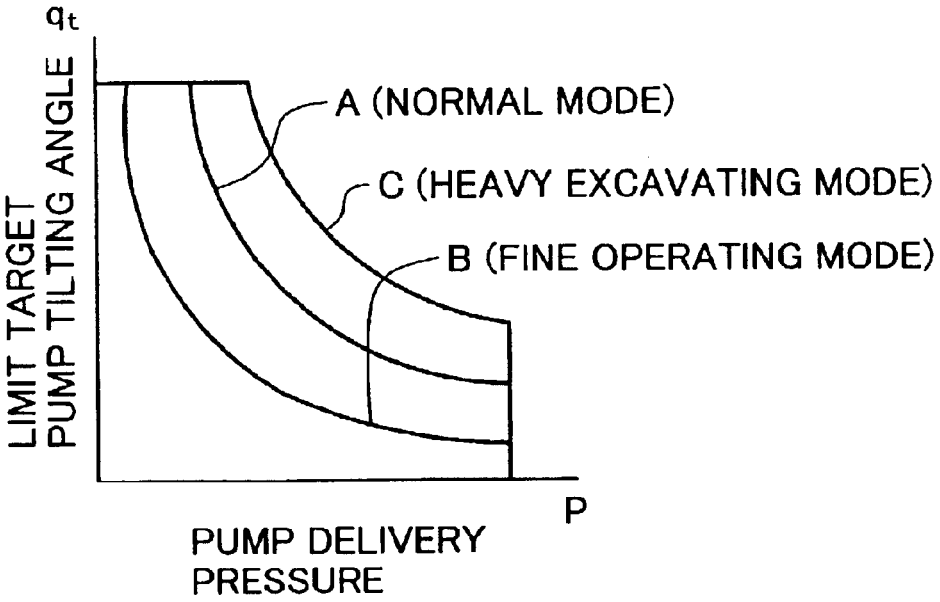
FIG. 26 illustrates a conversion map of input torque limiting control for performing horsepower limiting control of the hydraulic pump stored in the ROM of the controller shown in FIG. 25.

FIG. 26 illustrates a conversion map of input torque limiting control used in this embodiment for performing horsepower limiting control of the hydraulic pumps 1 to 6. The ROM 53 (see FIG. 3) of the controller 50A stores the conversion map shown in FIG. 26 instead of the conversion map shown in FIG. 4. This conversion map consists of a normal mode conversion map A, a fine operating conversion map B and a heavy excavating conversion map C and the controller 50A selects the normal mode conversion map A when the mode information signal of the mode changeover switch 70 indicates a normal mode position, selects the fine operating conversion map B when the mode information signal indicates a fine operating mode position, and selects the heavy excavating conversion map C when the mode information signal indicates a heavy excavating position. The controller 50A performs horsepower limiting control of the hydraulic pumps 1 to 6 using this selected conversion map as explained in the first embodiment.

Figure 27:
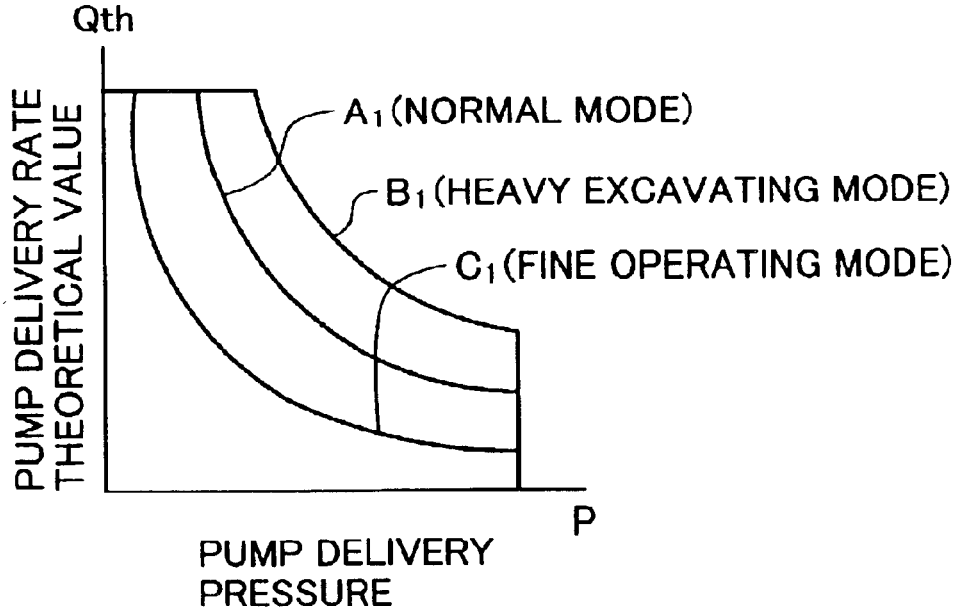
FIG. 27 shows a conversion map of a pump delivery pressure and a pump delivery rate theoretical value stored in the ROM of the controller shown in FIG. 25.

FIG. 27 shows a pump delivery pressure P-pump delivery rate theoretical value Qth conversion map used in this embodiment. The area 53*a* (see FIG. 3) of the ROM 53 of the controller 50A stores the conversion map shown in FIG. 27 instead of the conversion map shown in FIG. 8. The map shown in FIG. 27 corresponds to the conversion map of the input torque limiting control shown in FIG. 26, and consists of a normal mode conversion map A1, a fine operating mode conversion map B1 and a heavy excavating mode conversion map C1 wherein the corresponding mode according to a mode information signal of the operating mode changeover switch 70 is selected and made effective.

The data collection processing program stored in the area 53*b* (see FIG. 3) of the ROM 53 of the controller 50A is the same as that of the third embodiment shown in FIG. 19.

The area 53*c* (see FIG. 3) of the ROM 53 of the controller 50A stores a decision output processing program according to this embodiment. This processing is the same in content for each unit and the data collection processing of measured values from the measuring unit 21 and the decision output processing will be explained in detail by way of an example.

Figure 28:
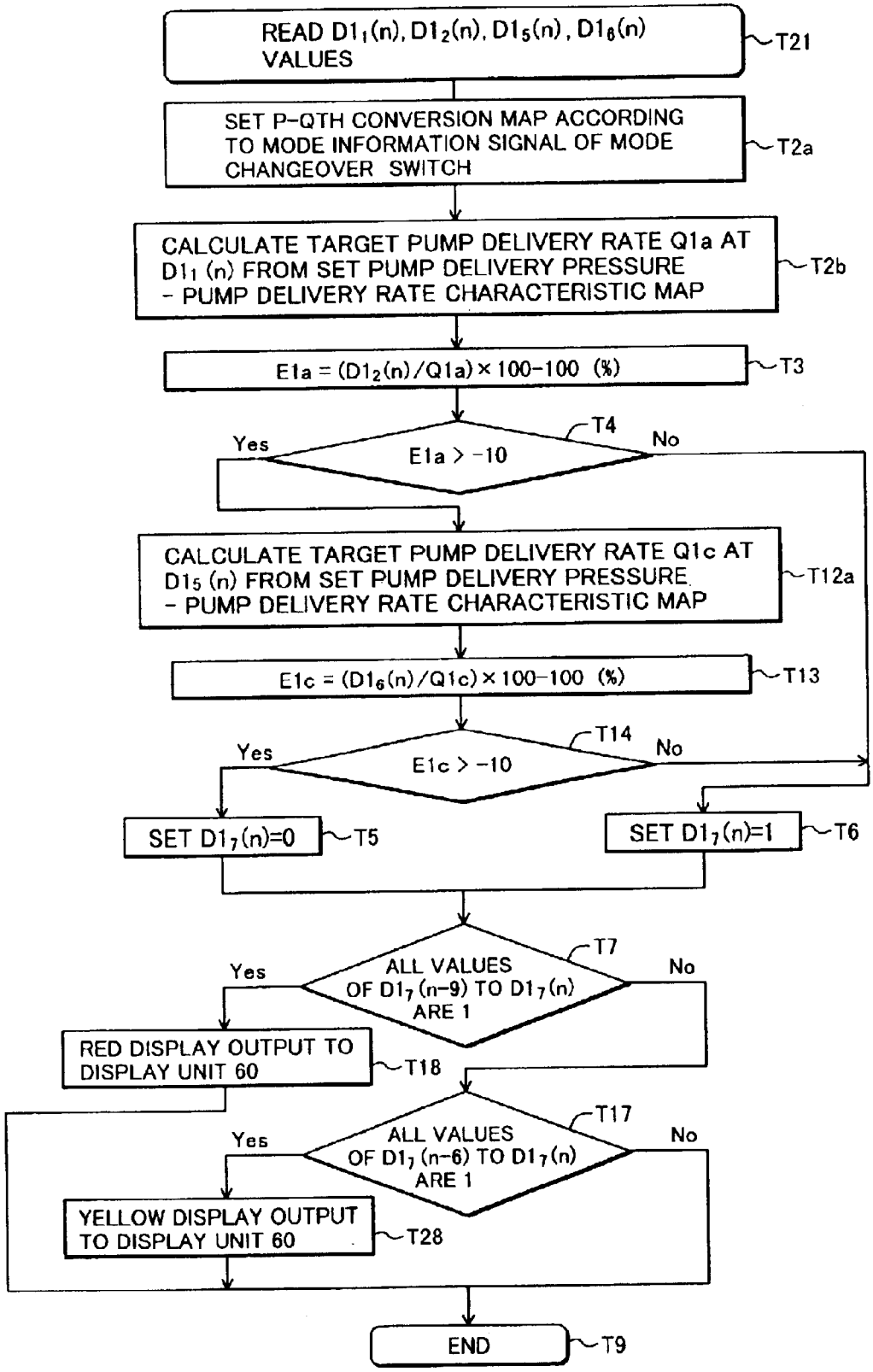
FIG. 28 shows a flow chart of a decision output processing program of the pump fault diagnostic apparatus stored in the ROM of the controller shown in FIG. 25.

FIG. 28 shows a flow chart of a decision output processing program. In FIG. 28, the same steps as those in FIG. 10 and FIG. 20 are designated with the same reference numerals.

In FIG. 28, this decision output processing program is different from that shown in FIG. 20 in the following points:

In FIG. 28, after in first step T21, the values $D1_1(n)$, $D1_2(n)$ and the values $D1_5(n)$, $D1_6(n)$ at the data collection processing count n are read to start the processing at first, the corresponding mode is selected and set from the conversion map shown in FIG. 27 according to the mode information signal of the mode changeover switch 70 (T2*a*). That is, the normal mode conversion map A1 is selected when the mode changeover switch 70 is at the normal mode position, the fine operating mode conversion map B1 is selected when the mode changeover switch 70 is at the fine operating mode position and the heavy excavating mode conversion map C1 is selected when the mode changeover switch 70 is at the heavy excavating mode position, and the respective maps are set as the conversion maps to be used for the decision output processing program.

Then, a target pump delivery rate theoretical value Q1*a* at the pressure value $D1_1(n)$ is calculated according to the set conversion map (T2*b*). Then, in step T3, an E1*a* value is calculated and it is decided in step T4 whether the calculated E1*a* value is greater than −10% or not (whether the actual pump delivery rate $D1_2(n)$ is different from the target pump delivery rate theoretical value Q1*a* by −10% or more) and then if the E1*a* value is greater than −10%, the target pump delivery rate value Q1*c* at the pressure value $D1_5(n)$ is calculated using the conversion map set in step T2*a* (T12*a*). Then, in step T13, an E1*c* value is calculated and it is decided in step T14 whether the calculated E1*c* value is greater than −10% or not (whether the actual pump delivery rate $D1^5(n)$ is different from the target pump delivery rate theoretical value Q1*a* by −10% or more) and then if the E1*c* value is greater than −10%, the $D1_7(n)$ value is set to 0 (T5). Furthermore, if at least one of the E1*a* value or E1*c* value is smaller than −10%, the $D1_7(n)$ value is set to 1 (T6).

Then, the 10 decision results from the past data collection processing count (n−9) to n as shown in FIG. 21 are read, and it is decided whether all the values $D1_7(n-9)$ to $D1_7(n)$ decided in steps T4 and T14 are 1 or not (T7)and if all the values are 1, the hydraulic pump 1 is decided to be completely faulty and a red display signal is output to the display unit 60 through the signal line 161 (T18). The display unit 60 turns on the corresponding lamp in red. When all the values $D1_7(n-9)$ to $D1_7(n)$ are not 1, it is decided whether all the five values $D1_7(n-6)$ to $D1_7(n)$ are 1 or not (T17), and if all the five values are 1, the hydraulic pump 1 is decided to have some possibility of being faulty and an yellow display signal is output to the display unit 60 through the signal line 161 (T28). The display unit 60 turns on the corresponding lamp in yellow. Furthermore, the display unit 60 may also be provided with a monitor unit to display the data in FIG. 11 by the request of the operator in this case, too.

Thus, according to this embodiment, in the hydraulic drive system in which the horsepower limiting control characteristic can be changed by the mode changeover switch, it is possible to detect a fault by automatically determining which of the hydraulic pumps 1 to 6 has a problem during an actual operation of the working machine and further to detect a fault when there is any problem with horsepower limiting control of the hydraulic pumps 1 to 6.

Furthermore, according to this embodiment, since lamps of the display unit 60 are turned on in different colors depending on a case where a hydraulic pump is completely faulty and a case where the hydraulic pump is possibly faulty, it is possible to warn the operator of a machine about details of the current fault conditions of the hydraulic pumps.

Figure 29:
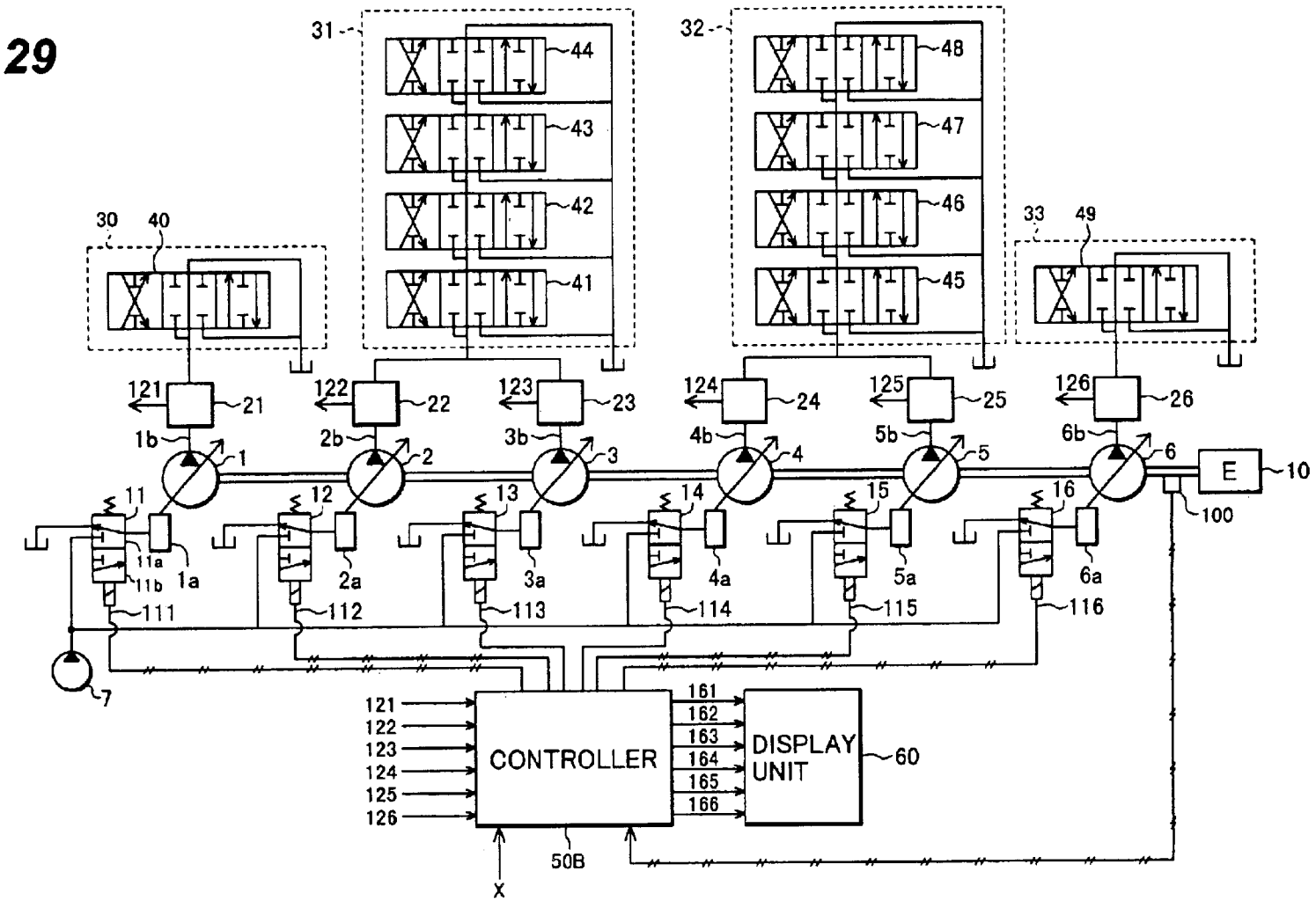
FIG. 29 illustrates a pump fault diagnostic apparatus according to a sixth embodiment of the present invention together with a hydraulic drive system equipped with the pump fault diagnostic apparatus.

A sixth embodiment of the present invention will be explained by using FIG. 4 to FIG. 8 and FIG. 29 to FIG. 31. This embodiment applies to a case where the horsepower limiting control characteristic is changed depending on the engine speed. In FIG. 29, the same components as those in FIG. 1 are designated with the same reference numerals.

In FIG. 29, the hydraulic drive system to which this embodiment relates comprises an engine speed sensor 100 additionally to the first embodiment shown in FIG. 1 and a signal of this engine speed sensor 100 is led to a controller 50B.

Figure 30:
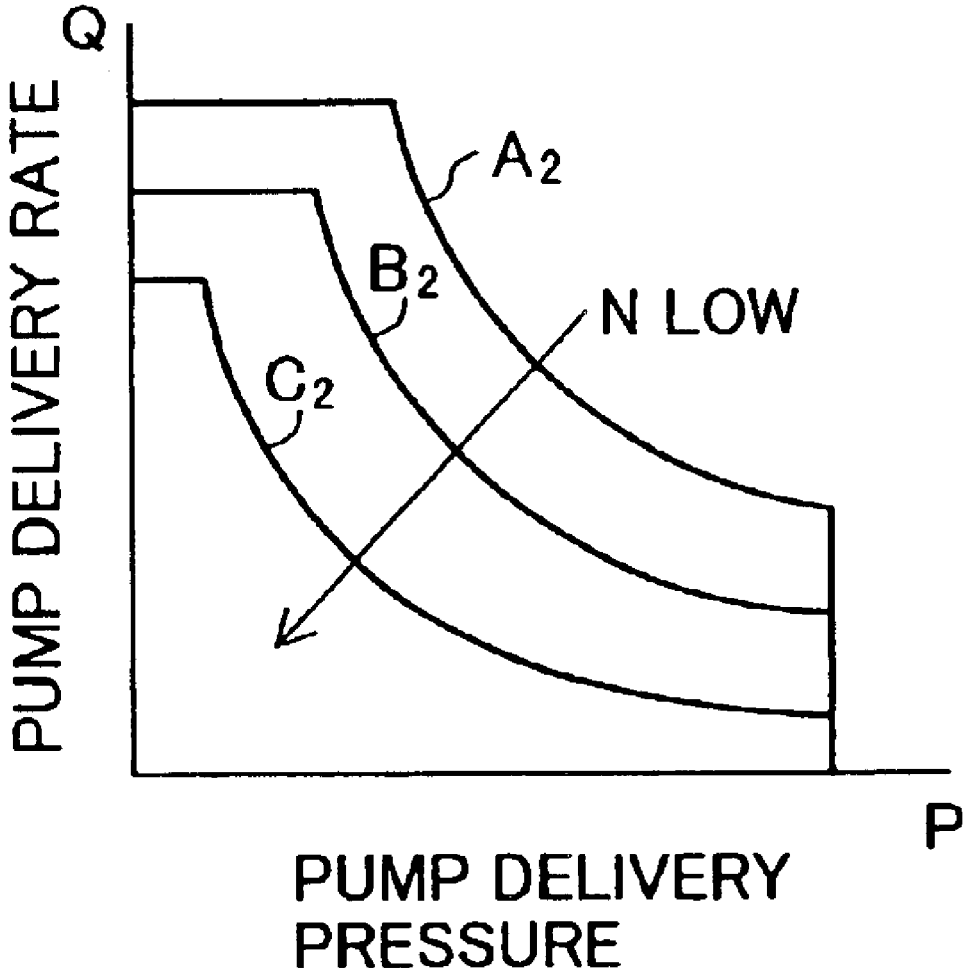
FIG. 30 shows a conversion map of a pump delivery pressure and a pump delivery rate theoretical value stored in the ROM of the controller shown in FIG. 29.

FIG. 30 shows a pump delivery pressure P—pump delivery rate theoretical value Qth conversion map used in this embodiment. The area 53*a* (see FIG. 3) of the ROM 53 of the controller 50B stores the conversion map shown in FIG. 30 instead of the conversion map shown in FIG. 8. This map is made in such a way that the limiting value (maximum value) of horsepower consumption of the hydraulic pump gradually decreases in order of A2, B2 and C2 as the engine speed N decreases, wherein the corresponding one according to a detection signal of the engine speed sensor 100 is selected and made effective.

The data collection processing program stored in the area 53*b* (see FIG. 3) of the ROM 53 of the controller 50B is the same as that of the third embodiment shown in FIG. 19.

The area 53*c* (see FIG. 3) of the ROM 53 of the controller 50B stores a decision output processing program according to this embodiment. This processing is the same in content for each unit and the data collection processing of measured values from the measuring unit 21 and the decision output processing will be explained in detail by way of an example.

Figure 31:
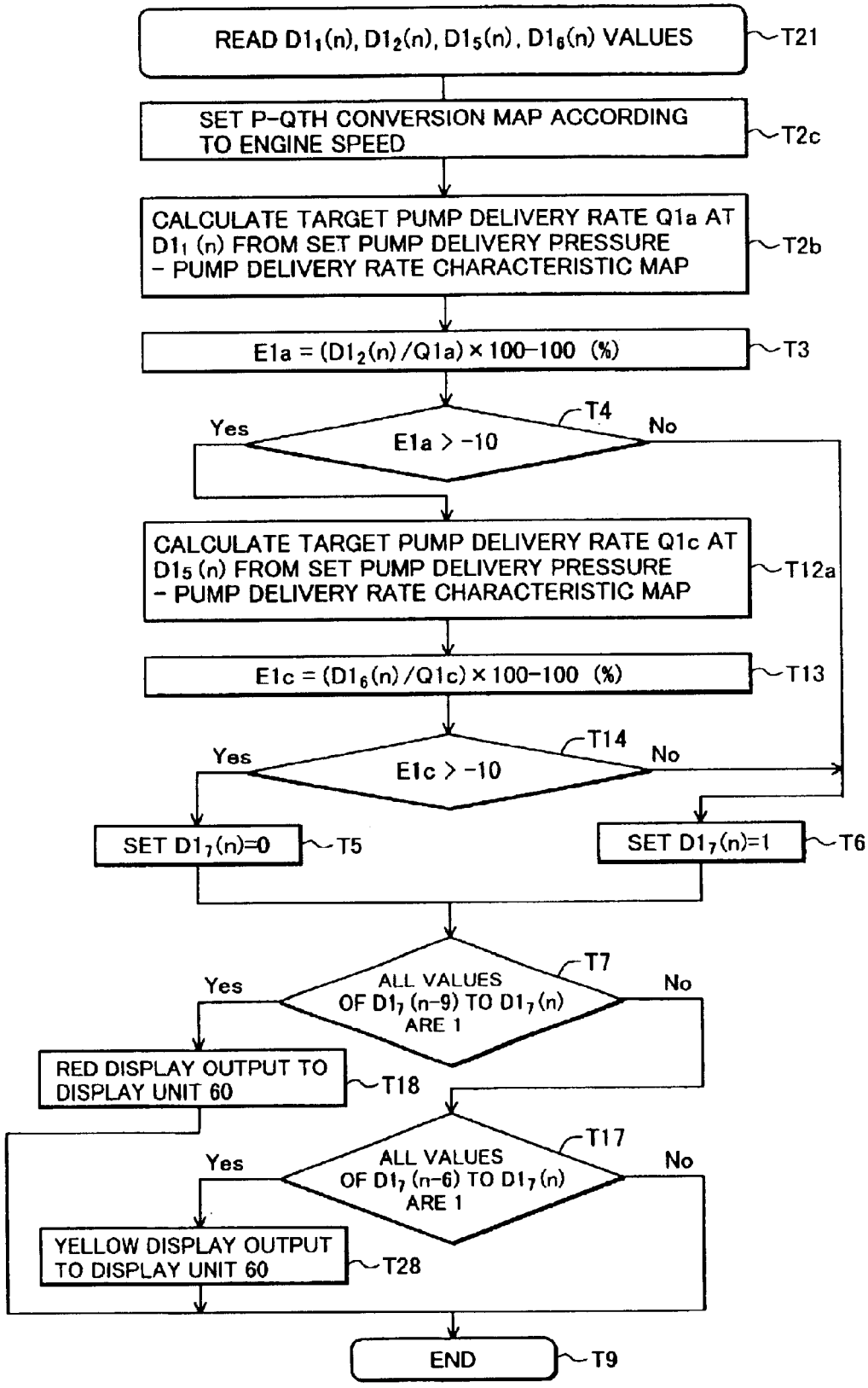
FIG. 31 shows a flow chart of a decision output processing program of the pump fault diagnostic apparatus stored in the ROM of the controller shown in FIG. 29.

FIG. 31 shows a flow chart of a decision output processing program. In FIG. 31, the same steps as those in FIG. 10, FIG. 20 and FIG. 28 are designated with the same reference numerals.

In FIG. 31, this decision output processing program is different in the processing in step T2*c* from that in step T2*a* shown in FIG. 28 and other portions are the same as those in FIG. 28. In step T2*c*, the corresponding engine speed is selected and set from the conversion map in FIG. 30 according to the detection signal of the engine speed sensor 100. That is, the conversion map A2 corresponding to a maximum rated engine speed is selected when the engine speed indicated by the detection signal of the engine speed sensor 100 is a value in the vicinity of the maximum engine speed, the conversion map B2 corresponding to an intermediate engine speed is selected when the engine speed is a value in the vicinity of the intermediate engine speed and the conversion map C2 corresponding to a low engine speed is selected when the engine speed is a value in the vicinity of the low engine speed, and these are set as conversion maps to be used for the decision output processing program. With the structure, even if the engine speed of the engine 10 is changed, a P-Qth conversion map corresponding to the engine speed is set and it is possible to make an accurate diagnosis of the fault situation of the hydraulic pump.

Thus, according to this embodiment, even if the engine speed of the engine 10 is changed, it is possible to detect a fault by automatically determining which of the hydraulic pumps 1 to 6 has a problem during an actual operation of the working machine and further to detect a fault when there is any problem with horsepower limiting control of the hydraulic pumps 1 to 6.

Figure 32:
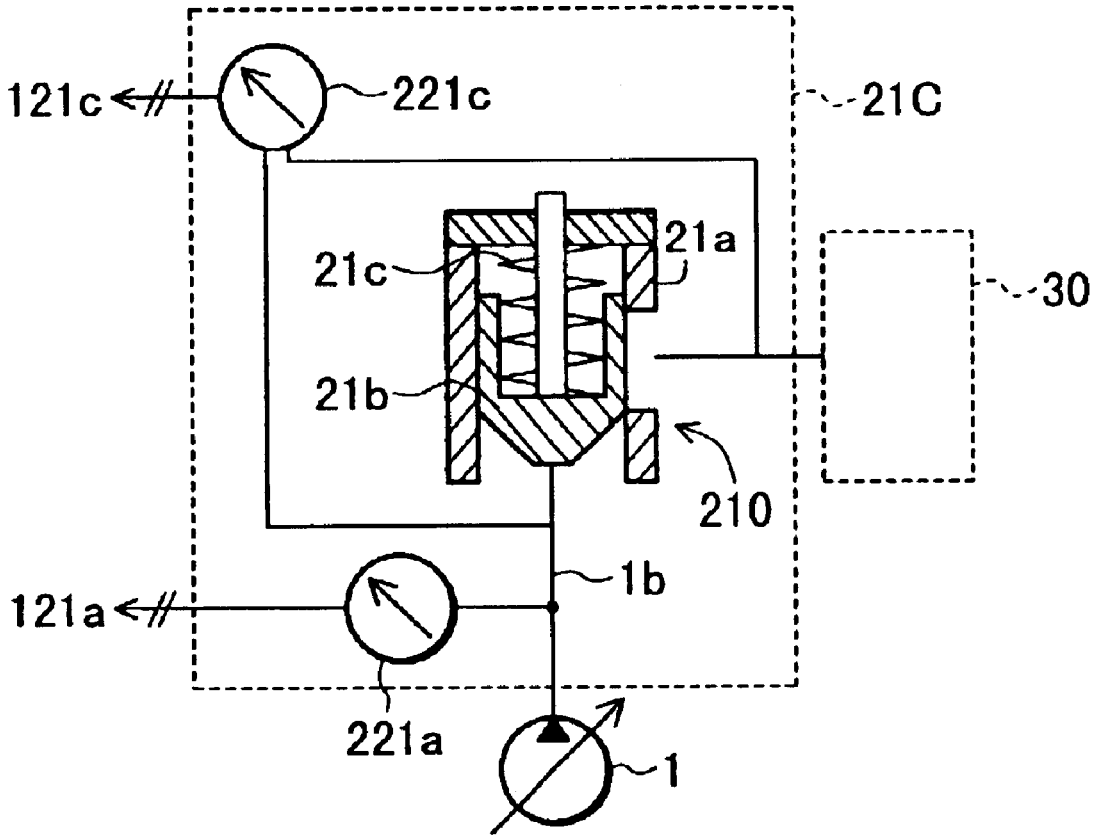
FIG. 32 is a detail view of a structure of a measuring unit used for a pump fault diagnostic apparatus according to a seventh embodiment of the present invention.

A seventh embodiment of the present invention will be explained by using FIG. 32. This embodiment shows another example of a structure of the measuring unit. In FIG. 32, the equivalent components as those in FIG. 2 are designated with the same reference numerals.

The measuring unit 21 shown in FIG. 2 includes the displacement sensor 21*b* for measuring a poppet displacement of the check valve 210 and measures a delivery rate of the hydraulic pump 1 according to the output result of this displacement sensor 21*b*, but in this embodiment, the measuring unit is configured to include a differential pressure sensor as shown in FIG. 32.

That is, in FIG. 32, in the measuring unit 21C according to this embodiment, a differential pressure sensor 221*c* is arranged for detecting a differential pressure between the pressure on the upstream side of the poppet 21*b* of the check valve 210 and that on the downstream side thereof, and the differential pressure across the poppet 21*b* that changes depending on the flow rate of the hydraulic fluid supplied from the delivery line 1*b* of the hydraulic pump 1 to the valve block 30 is detected by the differential pressure sensor 221*c* and the detected signal is output through the signal line 121*c*. The signal line 121*a* and signal line 121*c* constitute the signal line 121 (see FIG. 1).

The flow rate along the poppet 21*b* of the check valve 210 and the differential pressure across the check valve 210 have the following relationship:

$Q=c\sqrt{\Delta P/\rho}$

Q: Flow rate c: Flow rate coefficient

ΔP: Differential pressure

ρ: Viscosity coefficient of hydraulic operating fluid

The controller 50 (see FIG. 1) calculates the delivery rate of the hydraulic pump 1 from the above expression using the detection signal of the differential pressure sensor 221*c* input from the signal line 121.

The same applies to the measuring units placed in the delivery lines 2*b* to 6*b* of the hydraulic pumps 2 to 6.

In the above embodiments, the horsepower limiting control of the hydraulic pump is performed electronically using a conversion map stored in the controller, but a hydraulic regulator having a horsepower control port to introduce a delivery pressure of the hydraulic pump and directly controls the tilting of the hydraulic pump using the delivery pressure to perform horsepower limiting control may be used, and in this case the present invention is likewise applicable and similar advantages can be obtained.

Furthermore, in the above embodiments, what numerical value of the difference between the theoretical value of the pump delivery pressure—pump delivery rate and the actually measured values should be used to decide that a pump is faulty or how many data stored in the past should be compared to make a fault diagnosis can be changed in various ways according to the concept of a designer when a program of the controller is created or depending on the type of the machine, and those numerical value and data volume are not limited to the values explained in the above embodiments.

Furthermore, in the above embodiments, the storage of the nth data in the data collection processing program shown in FIG. 9, etc. is started when the engine starts, but it is also possible to provide a dedicated start button and start the storage of the nth data using the button or provide a timer to start the nth data storage every time the date is changed or every defined time of hours.

Industrial Applicability

According to the present invention, it is possible to make a fault diagnosis of a hydraulic pump automatically during an actual operation of a working machine and detect a fault when there is any problem with horse limiting control of the hydraulic pump.

Also, since the data collection and fault decision are performed for each hydraulic pump, it is possible to detect a fault of the hydraulic pump while determining which of a plurality of hydraulic pumps has a problem.

Furthermore, it is possible to detect faults of the hydraulic pump such as a fault where there is a problem with the tiling mechanism of the hydraulic pump and the hydraulic pump fails to reach the maximum tilting position or a fault where there is a problem with horsepower limiting control of the hydraulic pump and the delivery rate of the hydraulic pump as a whole does not reach a specified value of horsepower limiting control.

Furthermore, it is possible to detect faults of the hydraulic pump such as a fault where the delivery rate of the hydraulic pump fails to reach a specified value of horsepower limiting control when the delivery pressure of the hydraulic pump increases.

Furthermore, it is possible to warn an operator of a machine about a fault condition of the hydraulic pumps by the alarm lamps.

What is claimed is:

1. A pump fault diagnostic apparatus for a hydraulic drive system having at least one variable displacement hydraulic pump (1 to 6) and horsepower limiting control means (1*a* to 6*a*, 11 to 16, 50) for controlling said hydraulic pumps such that a maximum pump delivery rate is reduced as a delivery pressure of said hydraulic pump increases wherein said apparatus comprises:

first sensor means (21 to 26, 221*b*) for detecting the delivery rate of said hydraulic pump;

second sensor means (21 to 26, 221*a*) for detecting the delivery pressure of said hydraulic pump;

data collecting means (50, 53*b*) for measuring the pump delivery rate and pump delivery pressure during an actual operation of said hydraulic drive system based on the detected values of said plurality of first sensor means and second sensor means and collecting the measured values of said pump delivery rate and pump delivery pressure together as fault diagnostic data; and fault deciding means (50, 53*c*) for calculating a target pump delivery rate theoretical value of horsepower limiting control corresponding to the pump delivery pressure collected by said data collecting means using a preset relation between the pump delivery pressure and the pump delivery rate theoretical value, comparing the pump delivery rate collected by said data collecting means and said calculated target pump delivery rate theoretical value and making a fault decision of said hydraulic pump.

2. A pump fault diagnostic apparatus for a hydraulic drive system having a plurality of variable displacement hydraulic pumps (1 to 6) and horsepower limiting control means (1*a* to 6*a*, 11 to 16, 50) for controlling the plurality of hydraulic pumps such that respective maximum pump delivery rates are reduced as respective delivery pressures of said hydraulic pumps increase wherein said apparatus comprises:

first sensor means (21 to 26, 221*b*) for detecting the respective delivery rates of said plurality of hydraulic pumps;

second sensor means (21 to 26, 221*a*) for detecting the respective delivery pressures of said plurality of hydraulic pumps;

data collecting means (50, 53*b*) for measuring, for each of said hydraulic pumps, the pump delivery rate and pump delivery pressure during an actual operation of said hydraulic drive apparatus based on the detected values of said plurality of first sensor means and second sensor means and collecting the measured values of said pump delivery rate and pump delivery pressure together as fault diagnostic data; and fault deciding means (50, 53*c*) for calculating, for each of said hydraulic pump, a target pump delivery rate theoretical value of horsepower limiting control corresponding to the pump delivery pressure collected by said data collecting means using a preset relation between the pump delivery pressure and the pump delivery rate theoretical value, comparing the pump delivery rate collected by said data collecting means and said calculated target pump delivery rate theoretical value and making a fault decision of each of said hydraulic pumps.

3. The pump fault diagnostic apparatus for a hydraulic drive system according to claim 2, wherein said data collecting means (50, 53*b*) measures, for each of said hydraulic pumps, the pump delivery pressure and pump delivery rate when the pump delivery rate reaches a maximum during operation of said hydraulic drive system based on the detected values of said plurality of first sensor means and second sensor means and collects the measured values as fault diagnostic data.

4. The pump fault diagnostic apparatus for a hydraulic drive system according to claim 2, wherein said data collecting means (50, 53*b*) measures, for each of said hydraulic pumps, the pump delivery rate and pump delivery pressure when the pump delivery pressure reaches a maximum during operation of said hydraulic drive system based on the detected values of said plurality of first sensor means and second sensor means and collects the measured values as fault diagnostic data.

5. The pump fault diagnostic apparatus for a hydraulic drive system according to claim 2, wherein said data collecting means (50, 53*b*) measures, for each of said hydraulic pumps, the pump delivery pressure and pump delivery rate when the pump delivery rate reaches a maximum and the pump delivery rate and pump delivery pressure when the pump delivery pressure reaches a maximum during operation of said hydraulic drive system based on the detected values of said plurality of first sensor means and second sensor means and collects the measured values as fault diagnostic data.

6. The pump fault diagnostic apparatus for a hydraulic drive system according to claim 2, wherein said data collecting means (50, 53*b*) measures, for each of said hydraulic pumps, the pump delivery pressure and pump delivery rate when the pump delivery rate reaches a maximum, the pump delivery rate and pump delivery pressure when the pump delivery pressure reaches a maximum and the pump delivery rate and pump delivery pressure when the pump delivery pressure reaches a predetermined intermediate pressure during operation of said hydraulic drive system based on the detected values of said plurality of first sensor means and second sensor means and collects the measured values as fault diagnostic data.

7. The pump fault diagnostic apparatus for a hydraulic drive system according to claim 2, wherein each of said plurality of first sensor means (21 to 26) includes a displacement sensor (221*b*) for measuring a poppet displacement of a check valve (210) provided in the delivery line (1*b* to 6*b*) of each hydraulic pump (1 to 6) and calculates the delivery rate of each hydraulic pump from the output result of said displacement sensor.

8. The pump fault diagnostic apparatus for a hydraulic drive system according to claim 2, wherein each of said plurality of first sensor means (21C) includes a differential pressure sensor (221*c*) for measuring a differential pressure across a check valve (210) provided in the delivery line of each hydraulic pump (1) and calculates the delivery rate of each hydraulic pump from the output result of said differential pressure sensor.

9. The pump fault diagnostic apparatus for a hydraulic drive system according to claim 2, wherein said system further comprises:

fault displaying means (60) having a plurality of alarm lamps (60*a* to 60*f*) provided correspondingly to said plurality of hydraulic pumps (1 to 6) for turning on the corresponding alarm lamp when said fault deciding means (50, 53*c*) decides that any of the plurality of hydraulic pumps is faulty.

10. The pump fault diagnostic apparatus for a hydraulic drive system according to claim 9, wherein said fault displaying means (60) changes lamp colors between a case where there is a possibility of fault in the hydraulic pump and a case where the possibility is higher.

11. The pump fault diagnostic apparatus for a hydraulic drive system according to claim 2, wherein said data collecting means (50, 53*b*) collects said fault diagnostic data for every operation of said hydraulic drive system and said fault deciding means (50, 53*b*) decides whether said hydraulic pumps (1 to 6) are faulty or not based on the decision result of said fault diagnostic data for a predetermined number of times of the operations.

12. The pump fault diagnostic apparatus for a hydraulic drive system according to claim 2, wherein said fault deciding means (50B, 53C) includes a plurality of pump delivery pressure/pump delivery rate conversion maps, and selects one of them and calculates said target pump delivery rate using the selected conversion map.

13. A display unit (60) of a pump fault diagnostic apparatus for a hydraulic drive system having a plurality of variable displacement hydraulic pumps (1 to 6) and horsepower limiting control means (1*a* to 6*a*, 11 to 16, 50) for controlling a plurality of hydraulic pumps such that a maximum pump delivery rate is reduced as delivery pressures of these hydraulic pumps increase, wherein:

said display unit comprises a plurality of alarm lamps (60*a* to 60*f*) provided correspondingly to said plurality of hydraulic pumps (1 to 6), and turns on the corresponding alarm lamp when said pump fault diagnostic apparatus decides that there is a problem with said horsepower control means (1*a* to 6*a*, 11 to 16, 50) of any of the plurality of hydraulic pumps based on fault diagnostic data collected during an actual operation of said hydraulic drive apparatus.

* * * * *